US011117367B2

(12) United States Patent
Hori et al.

(10) Patent No.: US 11,117,367 B2
(45) Date of Patent: Sep. 14, 2021

(54) LIQUID DISCHARGE APPARATUS

(71) Applicant: Brother Kogyo Kabushiki Kaisha, Nagoya (JP)

(72) Inventors: Yuji Hori, Hashima-gun (JP); Kazuteru Kojima, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/715,824

(22) Filed: Dec. 16, 2019

(65) Prior Publication Data

US 2020/0189267 A1 Jun. 18, 2020

(30) Foreign Application Priority Data

Dec. 17, 2018 (JP) ..... JP2018-235505

(51) Int. Cl.
*B41J 2/045* (2006.01)

(52) U.S. Cl.
CPC ..... *B41J 2/0451* (2013.01); *B41J 2/04561* (2013.01); *B41J 2/04566* (2013.01); *B41J 2/04581* (2013.01)

(58) Field of Classification Search
CPC ..... B41J 2/04581; B41J 2/0451; B41J 2/04561; B41J 2/04566; B41J 2/14153; B41J 2/16579; G01L 5/1627
See application file for complete search history.

(56) References Cited

U.S. PATENT DOCUMENTS

| | | | | |
|---|---|---|---|---|
| 6,994,417 | B2 * | 2/2006 | Murayama | B41J 2/12 347/19 |
| 8,770,707 | B2 * | 7/2014 | Govyadinov | B41J 2/125 347/19 |
| 9,073,329 | B2 | 7/2015 | Sugahara et al. | |
| 2007/0064041 | A1 | 3/2007 | Sugahara | |
| 2012/0249670 | A1 | 10/2012 | Sugahara et al. | |

FOREIGN PATENT DOCUMENTS

| | | | |
|---|---|---|---|
| JP | 2001-277543 | A | 10/2001 |
| JP | 2006-130869 | A | 5/2006 |
| JP | 2007-136858 | A | 6/2007 |
| JP | 2009-226620 | A | 10/2009 |
| JP | 4882627 | B2 | 2/2012 |
| JP | 2012-206315 | A | 10/2012 |

* cited by examiner

*Primary Examiner* — Thinh H Nguyen
(74) *Attorney, Agent, or Firm* — Banner & Witcoff, Ltd.

(57) ABSTRACT

There is provided a liquid discharge apparatus, including: a conveyer; a head having a nozzle surface formed having a nozzle from which a liquid is discharged on a recording medium conveyed by the conveyer; a carriage carrying the head and configured to be movable in a scanning direction parallel to the nozzle surface in a movement range including a facing range that faces a passing area where the recording medium conveyed by the conveyer passes; a first conductor for detection arranged at a first side in the scanning direction relative to the passing area; and a second conductor for detection arranged at a second side, which is opposite to the first side, in the scanning direction relative to the passing area.

23 Claims, 14 Drawing Sheets

VOLTAGE SIGNAL OF DETECTION ELECTRODE
(A CASE IN WHICH INK IS DISCHARGED FROM NOZZLE
AS DISCHARGE TARGET)

VOLTAGE SIGNAL OF DETECTION ELECTRODE
(A CASE IN WHICH NO INK IS DISCHARGED FROM NOZZLE
AS DISCHARGE TARGET)

LIQUID DISCHARGE APPARATUS

CROSS REFERENCE TO RELATED APPLICATION

The present application claims priority from Japanese Patent Application No. 2018-235505 filed on Dec. 17, 2018, the disclosure of which is incorporated herein by reference in its entirety.

BACKGROUND

Field of the Invention

The present disclosure relates to a liquid discharge apparatus.

Description of the Related Art

There is known an ink-jet printer including a platen that supports a recording sheet (recording medium), a carriage that reciprocates in a left-right direction, and a printing head that is carried on the carriage. The ink-jet printer includes an electrode (a conductor for detection for detection) at a position on the right of the platen. Ink is discharged from nozzles of the printing head in a state where the printing head is in a home position facing the electrode member. The ink discharged from the nozzles causes an electrical change in the electrical member. A nozzle inspection is executed based on a signal output from the electrode member to inspect a discharge state of the nozzle(s).

SUMMARY

In the above-described ink-jet printer, however, the carriage is required to move to the home position every time the nozzle inspection is executed. For example, the carriage may be in a position far away from the home position when the nozzle inspection is executed during image recording on a recording sheet. In this case, a time for moving the carriage to the home position is long, which consequently lengthens a time until the nozzle inspection starts. Thus, a technology in which the nozzle inspection is executed as soon as possible is conventionally requested. Alternatively, a technology in which the nozzle inspection is executed accurately is conventionally requested.

An object of the present disclosure is to provide a liquid discharge apparatus capable of shortening a time until determination of a discharge state of a nozzle starts, or provide a liquid discharge apparatus capable of determining the discharge state of the nozzle accurately.

According to an aspect of the present disclosure, there is provided a liquid discharge apparatus, including: a conveyer; a head having a nozzle surface in which a nozzle is opened; a carriage configured to carry the head, the carriage being movable in a scanning direction parallel to the nozzle surface in a movement range including a facing range that faces a passing area where a recording medium conveyed by the conveyer passes; a first conductor for detection arranged at a first side in the scanning direction relative to the passing area, and configured to generate an electrical detection signal responding to landing a liquid discharged from the nozzle onto the first conductor for detection; and a second conductor for detection arranged at a second side, which is opposite to the first side, in the scanning direction relative to the passing area.

DESCRIPTION OF THE EMBODIMENTS

Figure 1:
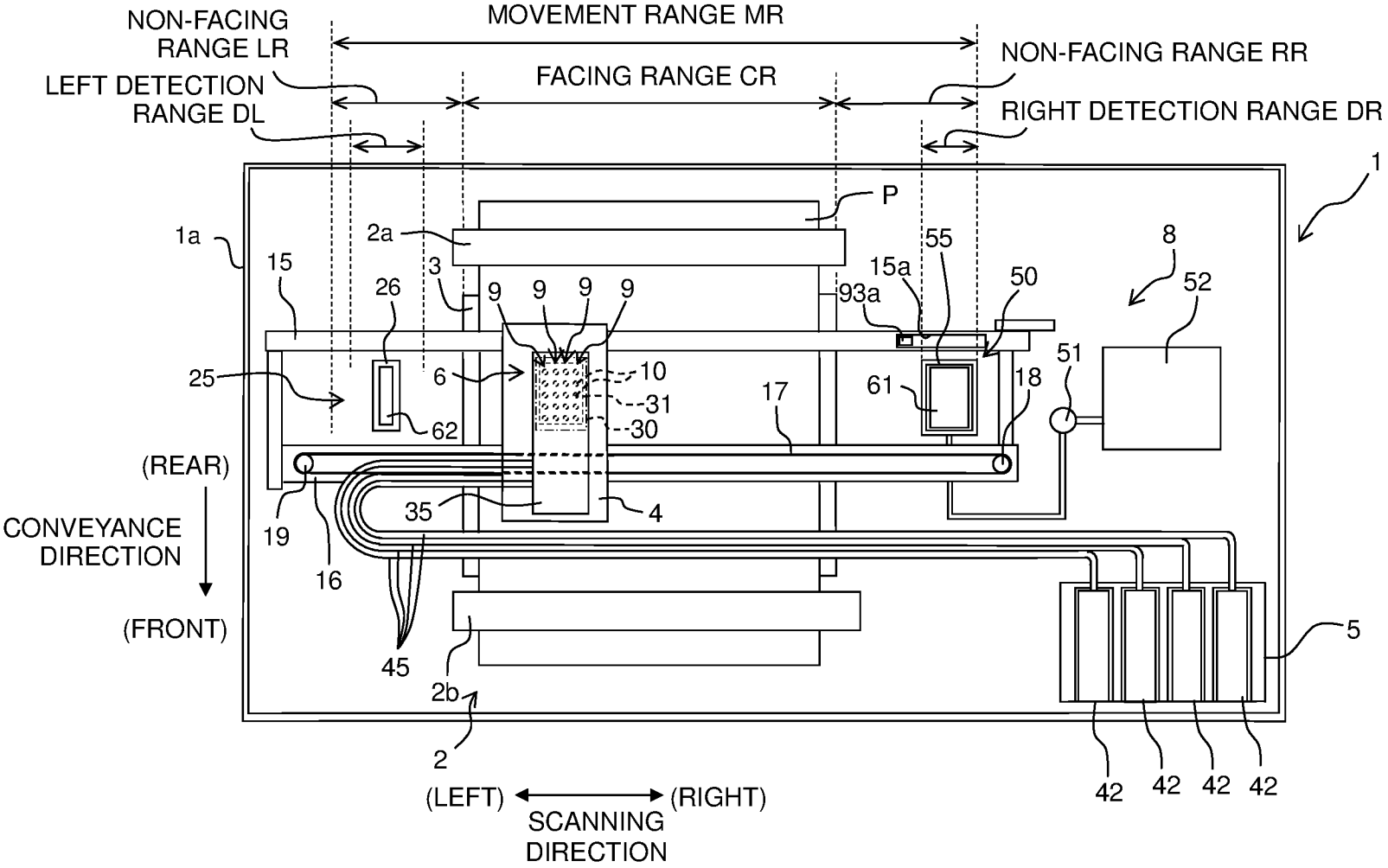
FIG. 1 schematically depicts an ink-jet printer according to an embodiment.

A schematic configuration of an ink-jet printer 1 (corresponding to a liquid discharge apparatus of the present disclosure, hereinafter referred to as a printer 1) according to an embodiment of the present disclosure is explained. As depicted in FIG. 1, the printer 1 includes a casing 1*a* having a substantially rectangular parallelepiped shape. The casing 1*a* accommodates a conveyer 2 (corresponding to a conveyer of the present disclosure), a platen 3, a carriage 4, a holder 5, a head unit 6, a maintenance mechanism 8, a driving-force switching mechanism 23 (see FIG. 5), a flushing receiver 25 (corresponding to a liquid receiver of the present disclosure), a nozzle inspection apparatus 40 (see FIG. 4), a controller 100 (see FIG. 2), and the like. In the following, the fore side (front side) of the sheet surface of FIG. 1 is defined as up (upward) of the printer 1, and the far side (the other side) of the sheet surface of FIG. 1 is defined as down (downward) of the printer 1. Further, a front-rear direction and a left-right direction in FIG. 1 are defined as a front-rear direction and a left-right direction of the printer 1. The following explanation is made based on those definitions.

The conveyer 2 includes two conveyance rollers 2*a* and 2*b* arranged in the front-rear direction. The two conveyance rollers 2*a* and 2*b* are driven in synchronization with each other by a conveyance motor 21 (see FIG. 2). Driving the two conveyance rollers 2*a* and 2*b* by the conveyance motor 21 conveys a sheet P frontward, which is a conveyance direction. The sheet P is a recording medium.

The platen 3 is interposed between the two conveyance rollers 2*a* and 2*b* in the front-rear direction. The platen 3 supports the sheet P conveyed by the conveyer 2 from below. The sheet P conveyed by the conveyer 2 passes on the platen 3. Two guide rails 15 and 16 extend parallelly to each other in the left-right direction (a scanning direction). The guide rails 15 and 16 are disposed above the platen 3.

The carriage 4, which is attached to the two guide rails 15 and 16, is movable in the scanning direction along the two guide rails 15 and 16. A driving belt 17 is attached to the carriage 4. The driving belt 17 is an endless belt stretched between two pulleys 18 and 19. The pully 18 is coupled to a carriage driving motor 20 (see FIG. 2). Rotating and driving the pully 18 by the carriage driving motor 20 causes the driving belt 17 to run, which reciprocatingly moves the carriage 4 in the scanning direction. The head unit 6 carried on the carriage 4 also reciprocates in the scanning direction.

A movement range MR in the scanning direction of the carriage 4 includes a facing range CR positioned at a center portion in the scanning direction where the carriage faces the platen 3, a non-facing range RR positioned at the right of the facing range CR, and a non-facing range LR positioned at the left of the facing range CR. The right of the facing range CR corresponds to a first side of the present disclosure, and the left of the facing range CR corresponds to a second side of the present disclosure. The carriage 4 does not face the platen 3 in the non-facing ranges RR and LR. The facing range CR includes a range facing a passing area where the sheet P conveyed by the conveyer 2 passes.

The holder 5 is disposed at the front of the carriage 4 and at the right of the platen 3. Four ink cartridges 42 are removably installed in the holder 5. The four ink cartridges 42 contain a black ink, a yellow ink, a cyan ink, and a magenta ink, respectively.

The head unit 6 is carried on the carriage 4 with a space in between the head unit 6 and the platen 3. The head unit 6 and the carriage 4 reciprocatingly move in the scanning direction. The head unit 6 includes an ink-jet head 30 (hereinafter simply referred to as a head 30) and buffer tanks 35 that are disposed on an upper surface of the head 30 and temporarily store the respective inks to be supplied to the head 30. The respective buffer tanks 35 are removably connected to first ends of four flexible ink supply tubes 45. Second ends of the four ink supply tubes 45 are connected to the holder 5. The inks in the four ink cartridges 42 attached to the holder 5 are supplied to the respective buffer tanks 35 via the four ink supply tubes 45.

Figure 3A:
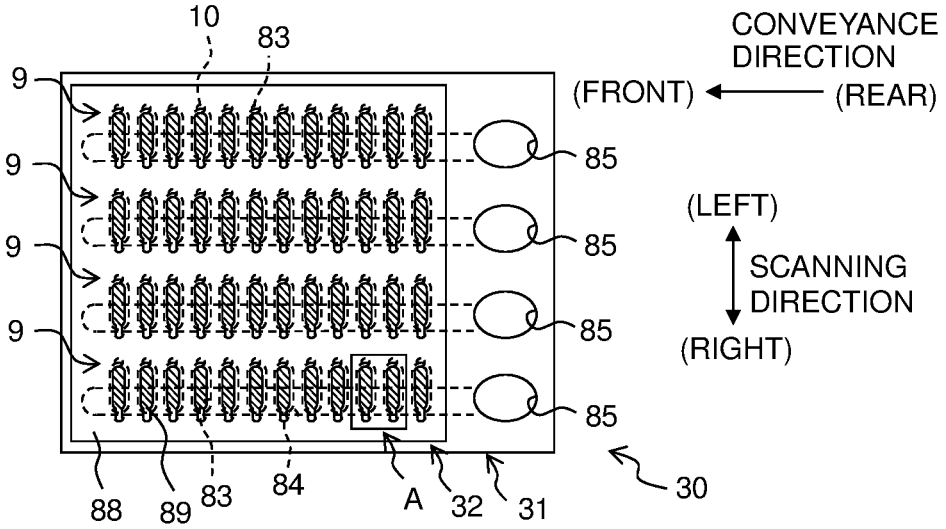
FIG. 3A is a plan view of the ink-jet head.

As depicted in FIG. 3A, the head 30 includes a channel unit 31 and an actuator 32. The channel unit 31 is formed having nozzles 10 and pressure chambers 83 that communicate with the respective nozzles 10. The channel unit 31 is made using a metal material and is connected to the ground potential. The actuator 32 is placed on an upper surface of the channel unit 31.

Figure 3B:
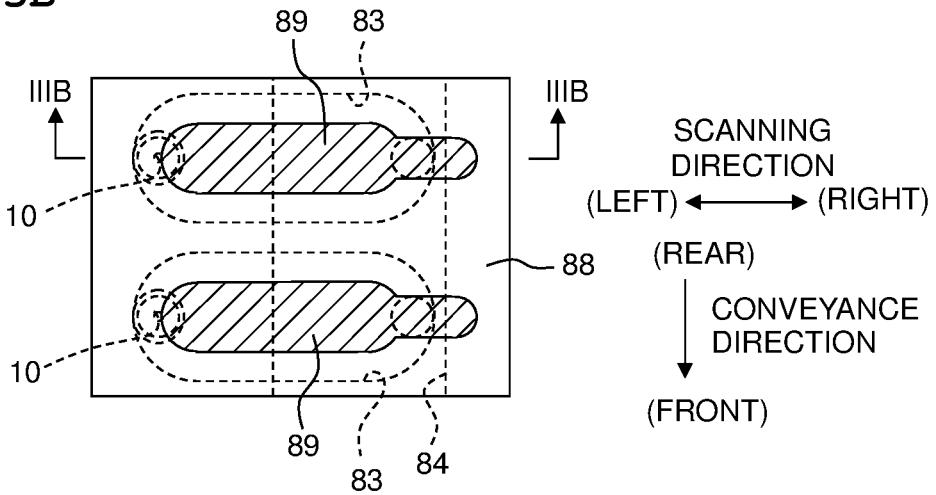
FIG. 3B is an enlarged view of an A portion in FIG. 3A.
Figure 3C:
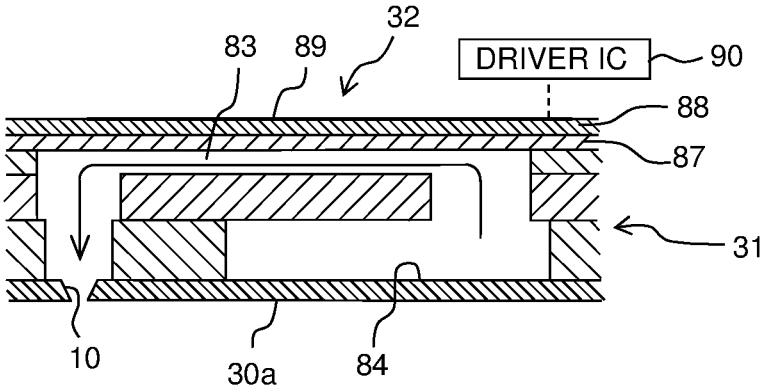
FIG. 3C is a cross-sectional view taken along a line IIIB-IIIB in FIG. 3B.

As depicted in FIG. 3C, the channel unit 31 is formed by stacking four plates. A lower surface of the channel unit 31 is a nozzle surface 30*a* where the nozzles 10 are open. The nozzle surface 30*a* is parallel to a horizontal plane. As depicted in FIG. 3A, the nozzles 10 are aligned in the front-rear direction (the conveyance direction of the sheet P) to form a nozzle row 9. Four nozzle rows 9 corresponding to the inks of four colors are arranged in the left-right direction. The black ink is discharged from the rightmost nozzle row 9 in the scanning direction, the yellow ink is discharged from the second rightmost nozzle row 9, the cyan ink is discharged from the third rightmost nozzle row 9, and the magenta ink is discharged from the leftmost nozzle row 9. The pressure chambers 83 are aligned to form a pressure chamber row, similar to the nozzles 10. Four pressure chamber rows are arranged in the left-right direction, similar to the four nozzle rows 9.

As depicted in FIGS. 3A and 3B, the channel unit 31 includes four manifolds 84 extending in the front-rear direction. The inks of four colors are supplied to the four respective pressure chamber rows through the four manifolds 84. The four manifolds 84 are connected to four ink supply openings 85 (corresponding to a liquid supply opening of the present disclosure) formed on the upper surface of the channel unit 31. The inks of four colors are supplied from the buffer tanks 35 to the four ink supply openings 85. The channel unit 31 thus includes individual channels each of which branches off from one of the manifolds 84 and reaches one of the nozzles 10 via one of the pressure chambers 83.

As depicted in FIG. 3C, the actuator 32 includes a vibration plate 87 covering the pressure chambers 83, a piezoelectric layer 88 disposed on an upper surface of the vibration plate 87, and individual electrodes 89 corresponding to the respective pressure chambers 83. The individual electrodes 89 positioned on an upper surface of the piezoelectric layer 88 are electrically connected to a driver IC 90 driving the actuator 32.

The vibration plate 87 positioned on a lower surface of the piezoelectric layer 88 is made using a metal material. The vibration plate 87 functions as a common electrode, which faces the individual electrodes 89 with the piezoelectric layer 88 interposed therebetween. The vibration plate 87 is connected to a ground line of the driver IC 90. The vibration plate 87 is always kept at the ground potential.

A driving signal having a predefined driving waveform is input from the driver IC 90 to the individual electrode 89. This deforms the volume of the piezoelectric layer 88 corresponding to the individual electrode 89 to which the driving signal is input, which applies pressure (discharge energy) to the ink in the pressure chamber 83. Ink droplets are thus discharged from the nozzle 10.

As described above, in this embodiment, the actuator that applies the discharge energy, by which ink is discharged from the nozzle 10, to ink is an actuator that deforms the volume of the pressure chamber 83 communicating with the nozzle 10 to apply the discharge energy. The present disclosure, however, is not limited thereto. For example, the actuator may be a heater that generates bubbles in the pressure chamber through heating to apply the discharge energy to ink.

Referring to FIG. 1, the maintenance mechanism 8 is configured to execute a maintenance operation for maintaining and recovering the discharge state of the head 30. The maintenance mechanism 8 includes a cap unit 50, a suction pump 51, a waste liquid tank 52, and the like.

Figure 4:
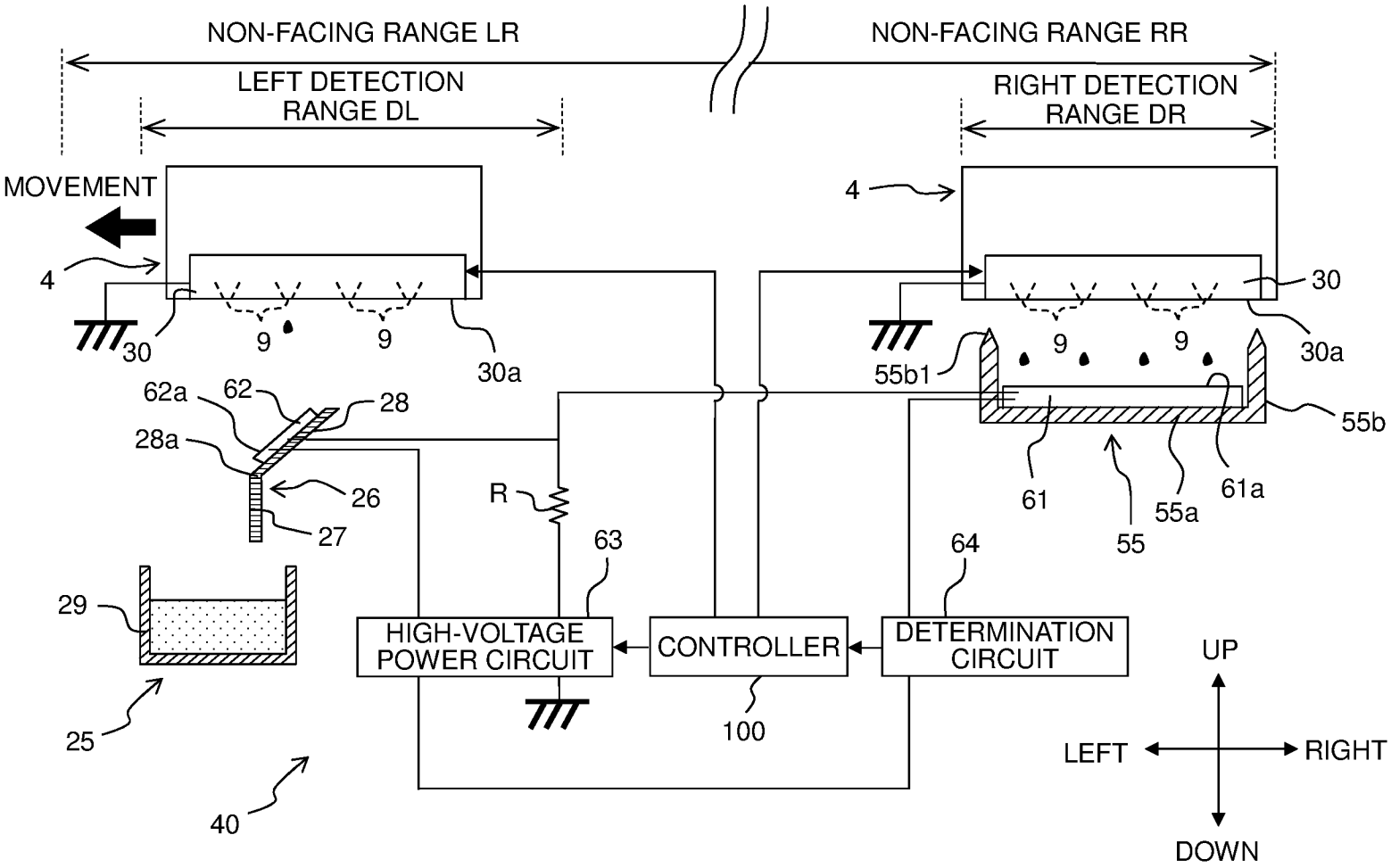
FIG. 4 illustrates a cap, a flushing receiver, and a nozzle inspection apparatus.

The cap unit 50 is disposed on the right of the platen 3. When the carriage 4 is positioned in a standby position, which is a right end of the movement range MR, the carriage 4 faces the cap unit 50 in an up-down direction. The cap unit 50 is movable in the up-down direction by being driven by a cap driving motor 22 (see FIG. 2). The cap unit 50 includes a cap 55 that can be brought into contact with the head 30. The cap 55 is made using, for example, a rubber material. As depicted in FIG. 4, the cap 55 includes a plate-like base portion 55*a* and a cylindrical lip portion 55*b* that stands upward from the circumference of the base portion 55*a*. For the convenience of explanation, FIG. 4 depicts the head unit 6, the cap 55, the flushing receiver 25, the nozzle inspection apparatus 40, and the controller 100. In FIG. 4, both the head 30 positioned in a right detection range DR and the head 30 positioned in a left detection range DL are depicted by solid lines.

When the carriage 4 faces the cap unit 50, the cap 55 faces the nozzle surface 30*a*. When the cap unit 50 moves upward in a state where the carriage 4 faces the cap unit 50, the cap unit 50 is installed in the head 30. In this situation, a tip 55*b*1 of the lip portion 55*b* of the cap 55 is brought into contact with the head 30. This causes the cap 55 to cover all the nozzles 10 belonging to the four nozzle rows 9. When the printer 1 is on standby, all the nozzles 10 are capped with the cap 55 to inhibit the increase in viscosity of inks in the nozzles 10. The suction pump 51 is connected to the cap 55.

In the printer 1, the controller 100 can control the maintenance mechanism 8 to execute a suction purge as the maintenance operation. The suction purge is a purge in which ink is forcibly discharged from the nozzles 10. In the suction purge, the suction pump 51 is driven in a state where the nozzles 10 are covered with the cap 55. This makes the pressure inside the cap 55 negative, forcibly discharging ink from the nozzles 10. The ink discharged from the head 30 into the cap 55 through the suction purge is delivered to the waste liquid tank 52 connected to the suction pump 51.

Figure 5A:
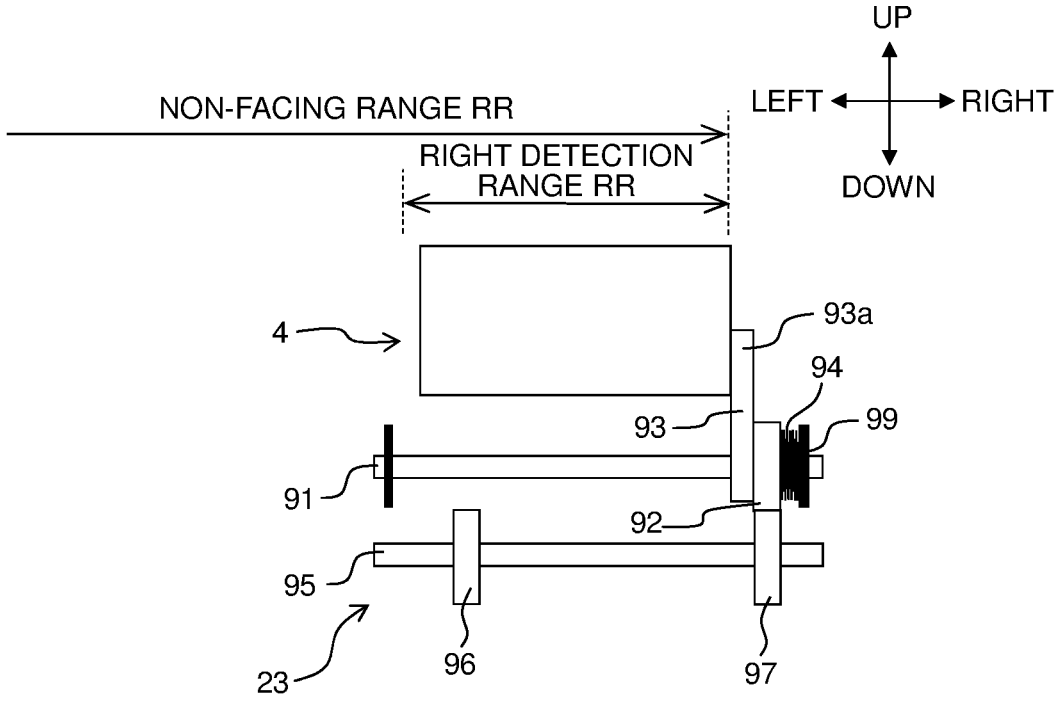
FIGS. 5A and 5B each illustrate a driving-force switching mechanism.
Figure 5B:
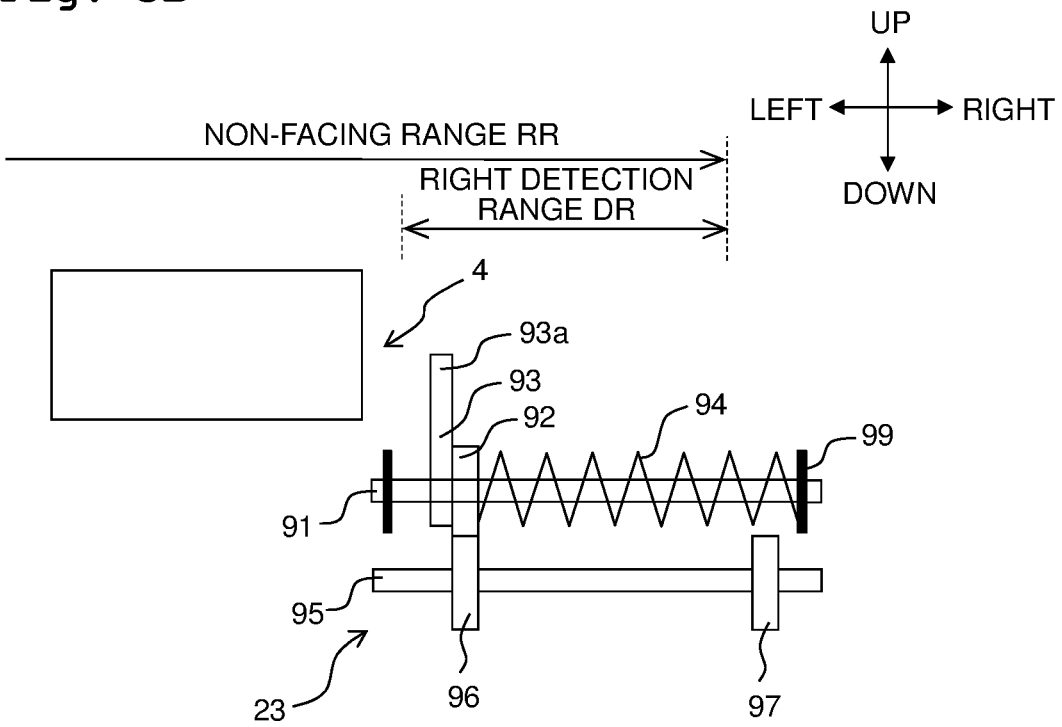

The driving-force switching mechanism 23 switches a state of the driving force of the conveyance motor 21 (corresponding to a driving source of the present disclosure) between a state where the driving force can be transmitted to the conveyance rollers 2*a* and 2*b* (corresponding to a driving object of the present disclosure) and a state where the driving force can be transmitted to the suction pump 51 (corresponding to the driving object of the present disclosure). Specifically, as depicted in FIGS. 5A and 5B, the driving-force switching mechanism 23 includes a shaft 91, a switching gear 92, a switching lever 93, a urging spring 94, a transmission shaft 95, a transmission gear 96 (sheet-feeding transmission gear 96), a transmission gear 97 (maintenance transmission gear 97), and the like.

The shaft 91 extends in the left-right direction. The shaft 91 is supported by a support member 99 at the right of the platen 3 below the guide rail 15. The shaft 9lis inserted into the switching gear 92 such that the switching gear 92 is slidably and rotatably supported by the shaft 91. The driving force of the conveyance motor 21 is transmitted to the switching gear 92 via an unillustrated transmission gear and the like. The shaft 91 is inserted into the switching lever 93 at the left of the switching gear 92 such that the switching lever 93 is slidably and rotatably supported by the shaft 91. The switching lever 93 includes a contact portion 93*a* that can be brought into contact with the carriage 4. The guide rail 15 is formed having a guide groove 15*a* (see FIG. 1) into which the contact portion 93*a* is inserted. The guide groove 15*a* extends in the left-right direction. The contact portion 93*a* can slide across the guide groove 15*a* in the left-right direction.

The urging spring 94 is a coil spring. The shaft 91 is inserted into the urging spring 94 such that the urging spring 94 is positioned at the right of the switching lever 93. A right end of the urging spring 94 is coupled to the support member 99.

The transmission shaft 95 is positioned below the shaft 91. The transmission shaft 95 is supported by an unillustrated support member such that the transmission shaft 95 is parallel to the shaft 91. The transmission gear 96 is rotatably supported at a predefined position on the transmission gear 95. The transmission gear 96 is coupled to driving shafts of the conveyance rollers 2*a* and 2*b* via an unillustrated transmission gear and the like. The transmission gear 97 is rotatably supported on the transmission shaft 95 such that the transmission gear 97 is positioned at a predefined position at the right of the transmission gear 96. The transmission gear 97 is connected to the suction pump 51 via an unillustrated transmission gear and the like. The switching gear 92 is configured to selectively mesh with the transmission gear 96 and the transmission gear 97.

In the above configuration, as depicted in FIG. 5A, the switching gear 92 meshes with the transmission gear 97 when the carriage 4 is positioned in the standby position. This allows the driving force of the conveyance motor 21 to be transmitted to the suction pump 51 and does not allow the driving force of the conveyance motor 21 to be transmitted to the conveyance rollers 2*a* and 2*b*. In this situation, the contact portion 93*a* of the switching lever 93 is brought into contact with a right end of the guide groove 15*a*.

As depicted in FIG. 5B, when the carriage 4 moves leftward from the standby position, the urging spring 94 urges the switching gear 92 and the switching lever 93, slidably moving the shaft 91 leftward. In this situation, the contact portion 93*a* of the switching lever 93 moves leftward along the guide groove 15*a*.

When the contact portion 93*a* of the switching lever 93 is brought into contact with a left end of the guide groove 15*a*, the leftward movement of the switching gear 92 and the switching lever 93 stops and the switching gear 92 and the switching lever 93 stay at this position. In this situation, the switching gear 92 meshes with the transmission gear 96. This allows the driving force of the conveyance motor 21 to be transmitted to the conveyance rollers 2*a* and 2*b* and does not allow the driving force of the conveyance motor 21 to be transmitted to the suction pump 51.

When the carriage 4 moves rightward from the facing range CR to the standby position, the carriage 4 is brought into contact with the contact portion 93*a* of the switching lever 93 to push the switching lever 93 and the switching gear 92 against the urging force of the urging spring 94, thus slidably moving the shaft 91 rightward. When the carriage 4 is positioned in the standby position, the switching gear 92 meshes with the transmission gear 97.

As described above, in this embodiment, the driving-force switching mechanism 23 switches the state of the driving force of the conveyance motor 21 between the state where the driving force of the conveyance motor 21 can be transmitted to the conveyance rollers 2*a* and 2*b* and the state where the driving force of the conveyance motor 21 can be transmitted to the suction pump 51. The switching of driving force of the conveyance motor 21 interlocks with the movement of the carriage 4.

As depicted in FIG. 1, the flushing receiver 25 is disposed on the left of the platen 3. As depicted in FIG. 4, the flushing receiver 25 includes a guide member 26 and a waste liquid tank 29. The guide member 26, which is made using a non-conductive plate-like member, has a vertical portion 27 and an inclined portion 28. The vertical portion 27 extends in the up-down direction. A lower end of the inclined portion 28 is connected to an upper end of the vertical portion 27. The inclined portion 28 is inclined to a horizontal plane so that its upper end is inclined rightward to its lower end. A second detection electrode 62 is placed on an upper surface 28*a* of the inclined portion 28, as described below in detail. An upper surface of the second detection electrode 62 is thus an inclined surface 62*a* inclined to the horizontal plane. The waste liquid tank 29 is placed below the guide member 26.

The printer 1 may execute a flushing operation when the carriage 4 is positioned in the left detection range DL. In the flushing operation, the actuator 32 of the head 30 is driven to discharge ink from the nozzles 10 to the flushing receiver 25. In the flushing operation, the ink discharged from the nozzles 10 of the head 30 lands on the inclined surface 62*a* of the second detection electrode 62. The ink landing on the inclined surface 62*a* slides down the inclined surface 62*a*, the inclined portion 28 of the guide member 26, and the vertical portion 27 in that order under its own weight, then held in the waste liquid tank 29. In this embodiment, the flushing operation is executed during the leftward movement of the carriage 4. The present disclosure, however, is not limited thereto. The flushing operation may be executed in a state where the carriage 4 is stopped.

The nozzle inspection apparatus 40 inspects the discharge state of the nozzles 10. The nozzle inspection apparatus includes a first detection electrode 61 (corresponding to a first conductor for detection of the present disclosure), the second detection electrode 62 (corresponding to a second conductor for detection of the present disclosure), a high-voltage power circuit 63, and a determination circuit 64.

The first detection electrode 61 is a flat-plate electrode. The first detection electrode 61 is in the cap 55 at a position closer to the base portion 55*a* than the tip 55*b*1 of the lip portion 55*b*. The first detection electrode 61 is thus placed on the right of the platen 3. An upper surface of the first detection electrode 61 is a facing surface 61*a* parallel to a horizontal plane. When the carriage 4 is positioned in the standby position, the first detection electrode 61 faces the four nozzle rows 9 in the up-down direction at a spaced interval. When ink is discharged from the nozzle(s) 10 in a state where the carriage 4 is positioned in the standby position, the ink lands on the facing surface 61*a* of the first detection electrode 61.

The second detection electrode 62 is a flat-plate electrode. The second detection electrode 62 is placed on the inclined portion 28 of the guide member 26. The second detection electrode 62 is thus placed on the left of the platen 3. The upper surface of the second detection electrode 62 is the inclined surface 62*a* inclined to a horizontal plane. The ink discharged from the nozzle(s) 10 lands on the inclined surface 62*a* of the second detection electrode 62 in the flushing operation and a second discharge-state determination operation described below.

As viewed in the up-down direction, the width in the left-right direction of the first detection electrode 61 is larger than the width in the left-right direction of a nozzle formation area in the nozzle surface 30*a* where the nozzles 10 are formed. As viewed in the up-down direction, the width in the left-right direction of the second detection electrode 62 is smaller than the width in the left-right direction of the nozzle formation area.

The two detection electrodes 61 and 62 are connected to the high-voltage power circuit 63 via resistance R. The controller 100 can control the high-voltage power circuit 63 to make the electrical potential of the two detection electrodes 61 and 62 a predefined positive potential. This generates a predefined difference in electrical potential between the head 30 connected to the ground potential and the two detection electrodes 61 and 62.

The determination circuit 64 compares a voltage value of a voltage signal output from each of the two detection electrodes 61 and 62 with a threshold value TH described below, and outputs its determination result to the controller 100. The controller 100 determines the discharge state of the nozzle(s) 10 based on the determination result from the determination circuit 64. The position of the determination circuit 64 is not especially limited, and the determination circuit 64 may be disposed at any position.

Figure 2:
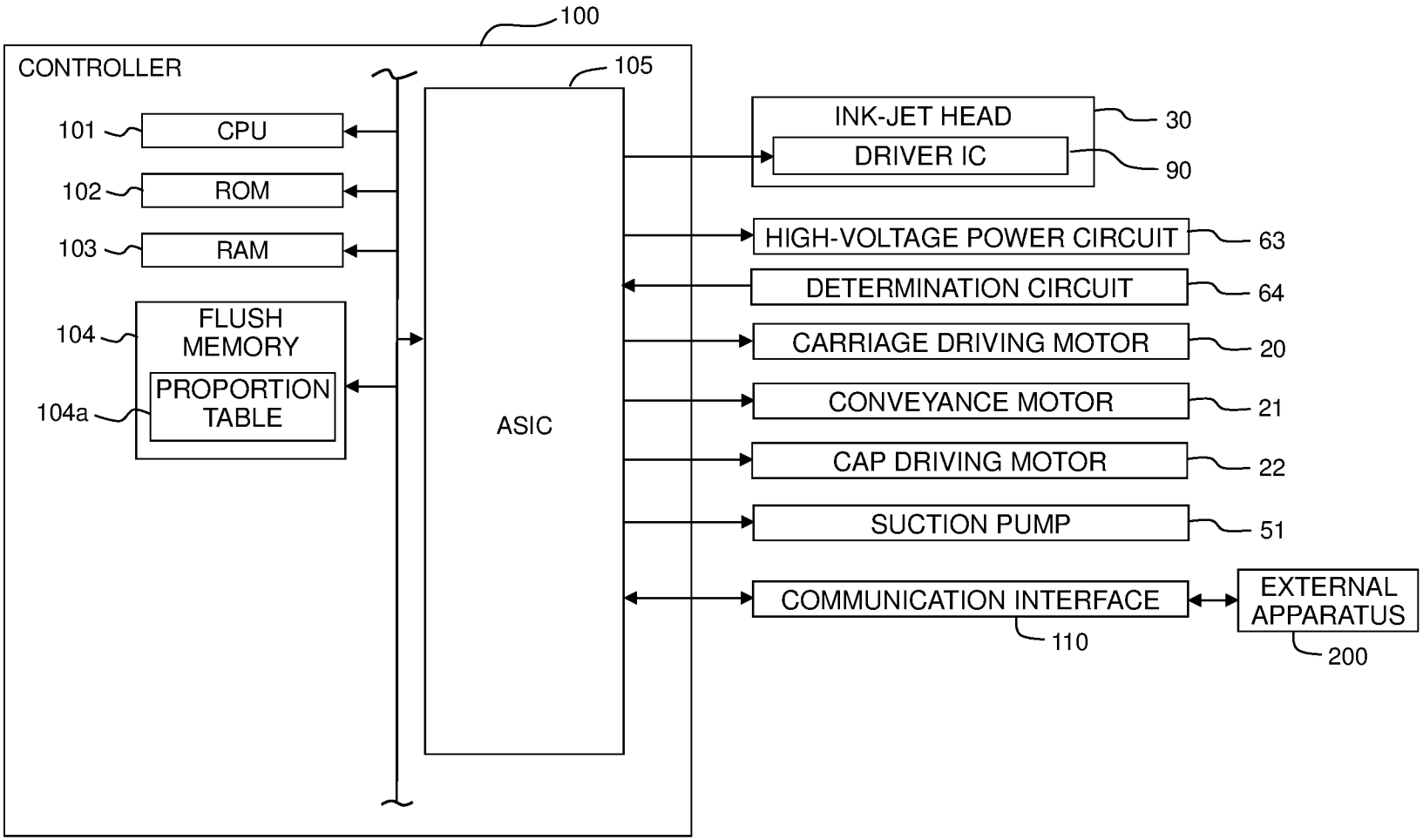
FIG. 2 is a block diagram schematically depicting an electrical configuration of the ink-jet printer.

As depicted in FIG. 2, the controller 100 includes a Central Processing Unit (CPU) 101, a Read Only Memory (ROM) 102, a Random Access Memory (RAM) 103, a flush memory 104, an Application Specific Integrated Circuit (ASIC) 105, and the like. The ROM 102 stores programs executed by the CPU 101, a variety of fixed data, and the like. The RAM 103 temporarily memorizes data and image data required for execution of the programs. The flush memory 104 memorizes a proportion table 104*a* described below. The ASIC 105 is connected to a variety of apparatuses and driving portions of the printer 1, such as the head 30, the carriage driving motor 20, the conveyance motor 21, and a communication interface 110.

In the controller 100, only the CPU 101 may execute a variety of processing, only the ASIC 105 may execute a variety of processing, or the CPU 101 may cooperate with the AISC 105 in a variety of processing. In the controller 100, the CPU 101 may execute processing alone or multiple CPU 101 may execute processing in a shared fashion. In the controller 100, the ASIC 105 may execute processing alone or multiple ASIC 105 may execute processing in a shared fashion.

The controller 100 controls the CPU 101 and the ASIC 105 to execute a variety of processing in accordance with programs stored in the ROM 102. For example, when the controller 100 receives a recording instruction from an external apparatus 200 via the communication interface 110, the controller 100 executes recording processing in which discharge processing and conveyance processing are alternately executed. In the discharge processing, ink is discharged from the nozzle(s) 10 during one movement (pass) in the scanning direction of the carriage 4 based on image data memorized in the RAM 103. In the conveyance processing, the conveyance rollers 2*a* and 2*b* convey the sheet P frontward by a predefined amount. Namely, the printer 1 of this embodiment is a serial-type ink-jet printer.

The printer 1 of this embodiment records an image on the sheet P using a unidirectional recording mode in which the discharge processing is executed only when the carriage 4 moves rightward. Thus, after the discharge processing is executed once during the rightward movement of the carriage 4 and before the next discharge processing starts, the controller 100 is required to execute a return operation in which the carriage 4 moves leftward while discharging no ink from the head 30. As a modified example, an image may be recorded on the sheet P using a bidirectional recording mode in which the discharge processing is executed independently of whether the carriage 4 moves rightward or leftward in the scanning direction.

The controller 100 controls the head 30, the nozzle inspection apparatus 40, and the like to execute a discharge state determination operation in which the discharge state of the nozzle(s) 10 is determined. In the discharge state determination operation of this embodiment, it is determined whether all the nozzles 10 that are determination targets are normal nozzles from which ink can be discharged or whether at least one nozzle 10 that is the determination target is an abnormal nozzle from which ink can not be discharged.

In this embodiment, the discharge state determination operation includes a first discharge-state determination operation and the second discharge-state determination operation. In the first discharge-state determination operation, the controller 100 drives the head 30 to discharge ink from the nozzles 10 as the determination targets sequentially in a state where the carriage 4 is positioned in the right detection range DR included in the non-facing range RR. The controller 100 determines whether each nozzle 10 as the determination target is the normal nozzle based on a voltage signal that is output from the first detection electrode 61 depending on the driving of the head 30.

The right detection range DR is a range in which the ink discharged from each nozzle 10 as the detection target can land on the first detection electrode 61. In this embodiment, the right detection area DR is a range corresponding to the standby position of the carriage 4. The position of a right end of the right detection range DR is the same as the position of the right end of the movement range MR.

In the second discharge-state determination operation, the controller 100 drives the head 30 to discharge ink from the nozzles 10 as the determination targets sequentially in a state where the carriage 4 is positioned in the left detection range DL included in the non-facing range LR. The controller 100 determines whether each nozzle 10 as the determination target is the normal nozzle based on a voltage signal that is output from the second detection electrode 62 depending on the driving of the head 30.

The left detection range DL is a range in which the ink discharged from each nozzle 10 as the detection target can land on the second detection electrode 62. A left end of the left detection range DL is at the right of a left end of the movement range MR. A distance between the left end of the left detection range DL and the left end of the movement range MR is thus longer than a distance between the right end of the right detection range DR and the right end of the movement range MR. When the carriage 4 is positioned at the right end of the movement range MR, the rightmost nozzle row 9 of the four nozzle rows 9 is positioned at the left of a right end of the first detection electrode 61. When the carriage 4 is positioned at the left end of the movement range MR, the leftmost nozzle row 9 of the four nozzle rows 9 is positioned at the left of a left end of the second detection electrode 62.

The controller 100 makes ink discharge timing of each nozzle 10 as the determination target in the first discharge-state determination operation different from that in the second discharge-state determination operation. More specifically, the controller 100 makes the ink discharge timing of each nozzle 10 in the first discharge-state determination operation different from that in the second discharge-state determination operation so that a period during which electrically change is caused in the detection electrodes 61 and 62 due to the ink discharged from a certain nozzle 10 does not overlap with a period during which electrically change is caused in the detection electrodes 61 and 62 due to the ink discharged from any other nozzle 10 than the certain nozzle 10.

The timing at which the discharge state determination operation is executed is not especially limited. For example, the timing may be a timing at which the printer 1 is turned on, a timing at which a recording instruction is received, a timing at which recording is executed for a predefined number of pages in the recording processing, and a timing at which recording corresponding to a predefined number of passes is executed in the recording processing. When executing the discharge state determination operation, the controller 100 selectively executes any of the first discharge-state determination operation and the second discharge-state determination operation.

As described above, when the carriage 4 moves from the facing range CR to the standby position (right detection range DR), the carriage 4 is brought into contact with the contact portion 93*a* of the switching lever 93. If the movement velocity of the carriage 4 is fast, big contact noise would be caused and the carriage 4 and the switching lever 93 would be damaged when the carriage 4 is brought contact with the contact portion 93*a*.

The landing surface of the first detection electrode 61 on which the ink discharged from the nozzle(s) 10 lands is the facing surface 61*a* parallel to the nozzle surface 30*a* (horizontal plane). When compared to a surface inclined to the horizontal plane such as the inclined surface 62*a* of the second detection electrode 62, the ink landing on the facing surface 61*a* of the first detection electrode 61 easily bounces off the facing surface 61*a*, so that the ink bounced off travels upward to the nozzle surface 60*a*. When ink is discharged from the nozzle(s) 10 during the movement of the carriage 4, inertial force is acted on the ink discharged from the nozzle(s) 10 to increase ink flying velocity. Thus, if the movement velocity of the carriage 4 is fast in the first discharge-state determination operation, the ink bounced off the first detection electrode 61 and the like in the cap 55 would easily scatter far and wide. The ink scattered is likely to adhere to the nozzle surface 30*a* of the head 30 and/or the lip portion 55*b* that may be brought into contact with the head 30.

When ink is discharged from the nozzle(s) 10 during the movement of the carriage 4, an ink flying direction is not an exactly downward direction (ink does not fly exactly downward in a vertical direction) due to the inertial force acted on ink, but a direction containing components of a movement direction of the carriage 4. In order to land ink on a desired position of the first detection electrode 61 in the cap 55 during the movement of the carriage 4 in the first discharge-state determination operation, ink is required to be discharged from a point of time at which the carriage 4 is positioned upstream in the movement direction from the standby position where the carriage 4 faces the cap 55. The first detection electrode 61, however, is in the cap 55 at the position closer to the base portion 55*a* than the tip 55*b*1 of the lip portion 55*b*. In that configuration, when the movement velocity of the carriage 4 is fast in the first discharge-state determination operation, the ink discharged from the nozzle(s) 10 is liable to land on the lip portion 55*b* rather than lands on the desired position of the first detection electrode 61.

The movement velocity of the carriage 4 is required to decrease in the vicinities of ends in the movement range MR of the carriage 4 to inhibit the carriage 4 from overrunning beyond the movement range MR. The right end of the right detection range DR is the same as the right end of the movement range MR. The left end of the left detection range DL is at the right of the left end of the movement range MR.

In view of the above, in this embodiment, the movement velocity of the carriage 4 in the first discharge-state determination operation is slower than that in the second discharge-state determination operation. Specifically, in the first discharge-state determination operation, the controller 100 drives the head 30 to discharge ink from the nozzle(s) 10 while stopping the carriage 4 in the right detection range DR. In other words, the controller 100 executes the first discharge-state determination operation when the carriage 4 is in the standby position.

In the second discharge-state determination operation, the controller 100 drives the head 30 to discharge ink from the nozzle(s) 10 while moving the carriage 4 leftward at a predefined movement velocity. The second discharge-state determination operation is executed immediately after the return operation (details are described below). The second discharge-state determination operation is executed during the leftward movement of the carriage 4 that continues from the return operation. Namely, the leftward movement of the carriage 4 is not stopped between the second discharge-state determination operation and the return operation.

When the recording processing is being executed, the carriage 4 is not required to move to the standby position (right detection range DR) except in the case of executing the suction purge. Thus, when the discharge state determination operation is executed during the execution of the recording processing, the execution of the second discharge-state determination operation having faster movement velocity of the carriage 4 than the first discharge-state determination operation shortens a time for the recording processing.

The controller 100 thus executes the first discharge-state determination operation when the carriage 4 is in the right detection range DR (standby position). For example, when the controller 100 receives a recording instruction with the carriage 4 positioned in the right detection range DR, the controller 100 executes the first discharge-state determination operation before executing the recording processing for the recording instruction.

The controller 100 executes the second discharge-state determination operation when the recording processing is being executed with the carriage 4 not positioned in the right detection range DR. In this embodiment, when the carriage 4 moves from the facing range CR to the left detection range DL during the execution of the recording processing, the controller 100 executes any one of the flushing operation and the second discharge-state determination operation. More specifically, when the cumulative number of movement of the carriage 4 from the facing range CR to the left detection range DL is a multiple of three during the execution of the recording processing, the controller 100 executes the second discharge-state determination operation. In other cases, the controller 100 executes the flushing operation.

The viscosity of the ink in each nozzle 10 increases as a non-discharge period, in which no ink is discharged from each nozzle 10, is longer. Thus, when a standby time of the printer 1 is long, the nozzles 10 of the head 30 are highly likely to be the abnormal nozzles due to the increase in viscosity of the ink in the nozzles 10 at the start of the recording processing. In order to solve that problem, the controller 100 sets all the nozzles 10 of the head 30 as the determination targets in the first discharge-state determination operation executed before the recording processing. When the controller 100 has determined in the first discharge-state determination operation that at least one nozzle 10 is the abnormal nozzle, the controller 100 controls the maintenance mechanism 8 to execute the suction purge. This allows all the nozzles 10 of the head 30 to be the normal nozzles before the recording processing starts.

The second discharge-state determination operation is a determination operation executed during the execution of the recording processing. In the second discharge-state determination operation of this embodiment, the controller 100 makes jetting timings of the respective nozzles 10 as the determination targets differ from each other. Thus, a time required for completing ink discharge from all the nozzles 10 as the determination targets is longer as the number of nozzles 10 set as the determination targets is larger. The width in the left-right direction of the second detection electrode 62 is smaller than the width in the left-right direction of the nozzle formation area as viewed in the up-down direction. Further, the controller 100 controls the carriage 4 to move leftward during the execution of the second discharge-state determination operation. Thus, the period during which the ink discharged from the nozzles 10 of the head 30 can land on the second detection electrode 62 is limited.

In order to allow the controller 100 to set all the nozzles 10 of the head 30 as the determination targets in the second discharge-state determination operation, the movement velocity of the carriage 4 during the execution of the second discharge-state determination operation is required to decrease. However, reducing the movement velocity of the carriage 4 lengthens the time required for the recording processing. Thus, in the second discharge-state determination operation of this embodiment, the controller 100 sets some of the nozzles 10 of the head 30 as the determination targets.

Whether the nozzle 10 easily has discharge failure may depend on the position where the nozzle 10 is formed. For example, the respective nozzles 10 belonging to each nozzle row 9 have different channel distances from the ink support opening 85 to the respective nozzles 10. Further, the viscosity of ink typically increases due to, for example, the volatilization of a solvent, as the ink stays in channels of the head 30 for a longer time. The discharge failure is thus likely to occur in the nozzle 10 having a longer channel distance from the ink support opening 85.

In order to solve the above problem, the controller 100 increases the frequency of setting, in which the nozzle 10 having a longer channel distance from the ink supply opening 85 is set as the determination target, in the second discharge-state determination operation. Specifically, the flush memory 104 memorizes the proportion table 104*a* in which a proportion of setting each nozzle 10 as the determination target in the second discharge-state determination operation is specified. In the proportion table 104*a*, the nozzle 10 having a longer channel distance from the ink supply opening 85 is made to have a larger proportion of being set as the determination target. The controller 100 determines in the second discharge-state determination operation which of the nozzle(s) 10 is/are set as the determination target(s) based on the proportion table 104*a*.

<Processing Operation of Ink-Jet Printer>

Figure 6A:
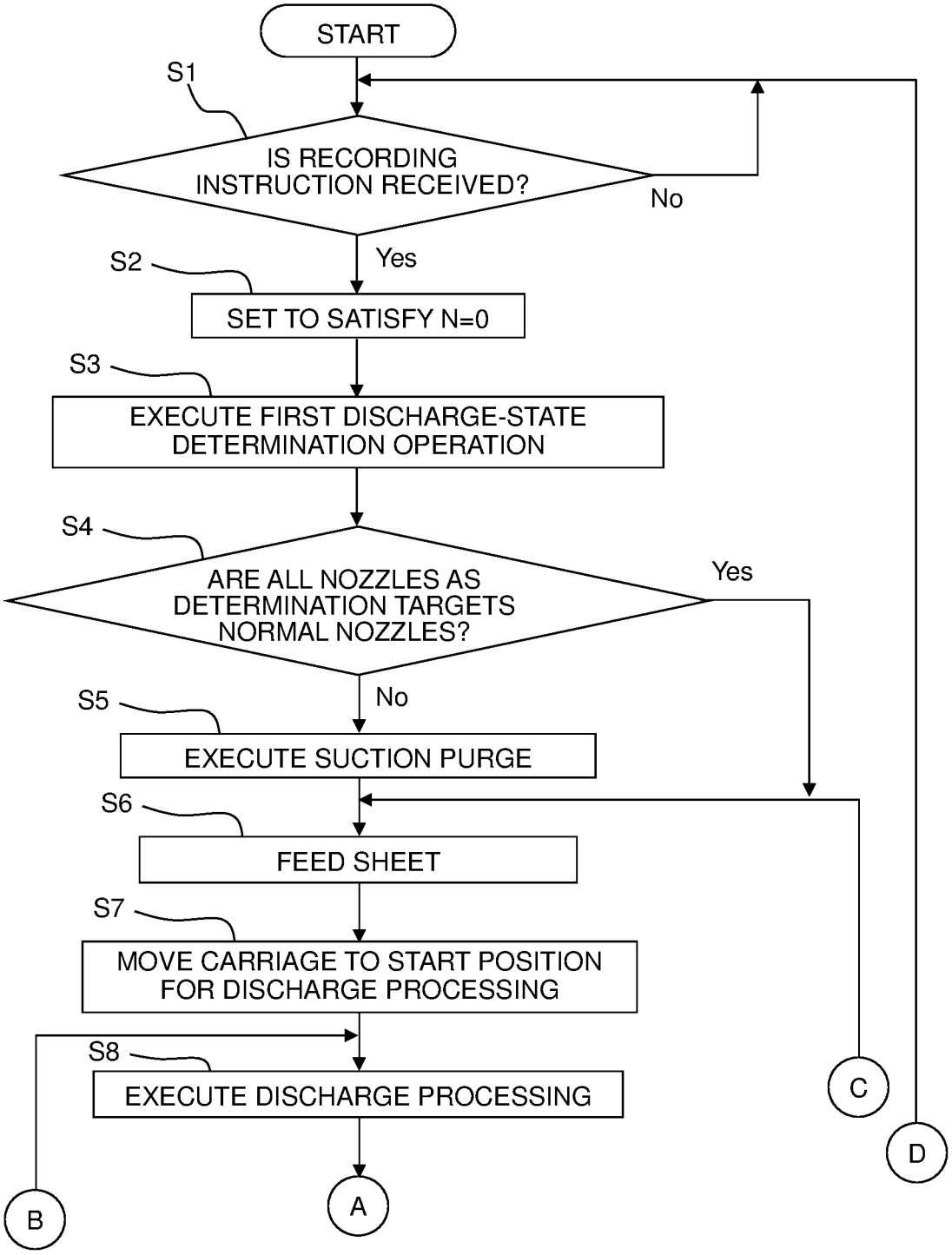
FIGS. 6A and 6B indicate a flowchart explaining processing operations of the ink-jet printer.
Figure 6B:
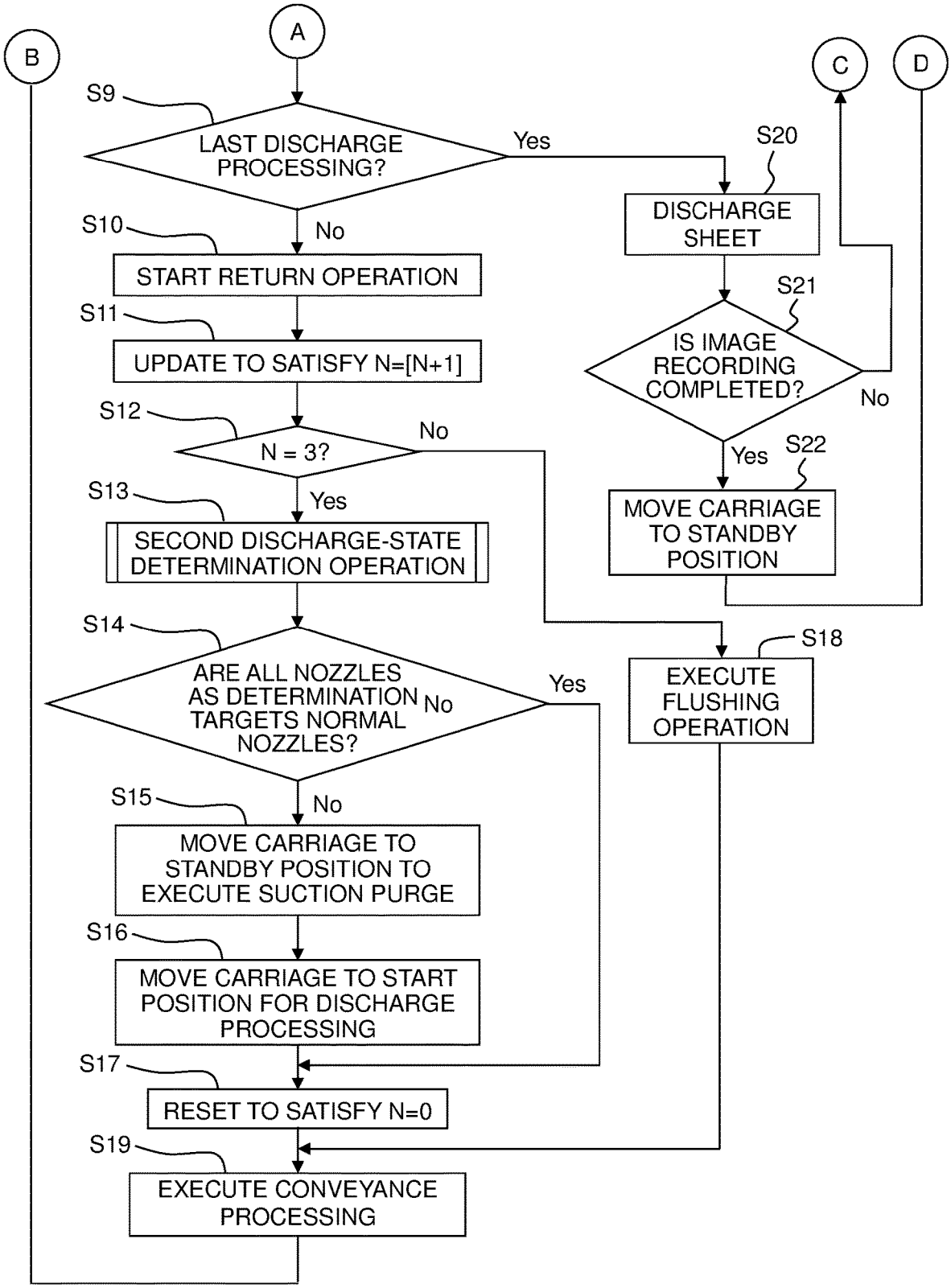

Referring to FIG. 6, an exemplary processing operation related to the discharge state determination operation of the printer 1 is explained below. The carriage 4 is in the standby position (right detection range DR) at the start of the flowchart in FIG. 6.

When receiving a recording instruction from the external apparatus 200 (Si: YES), the controller 100 sets a variable N to zero (S2). Then, the controller 100 executes the first discharge-state determination operation (S3), which is explained below while referring to FIG. 7. When the controller 100 has determined in the first discharge-state determination operation that all the nozzles 10 as the determination targets are the normal nozzles (S4: YES), the controller 100 proceeds to processing in S6. When the controller 100 has determined that at least one nozzle 10 as the determination target is the abnormal nozzle rather than the normal nozzle (S4: NO), the controller 100 controls the maintenance mechanism 8 to execute the suction purge (S5). The suction purge makes all the nozzles 10 of the head 30 the normal nozzles. After completing the processing in S5, the controller 100 proceeds to the processing in S6.

In the processing of S6, the controller 100 feeds the sheet P from a feed unit (not depicted) to a position where the sheet P can face the carriage 4. Then, the controller 100 controls the carriage driving motor 20 to move the carriage 4 leftward from the standby position to a position where the discharge processing starts (S7). Subsequently, the controller 100 executes the discharge processing, in which ink is discharged from the nozzles 10 of the head 30, while controlling the carriage driving motor 20, the head 30, and the like to move the carriage 4 rightward (S8). Subsequently, the controller 100 determines whether the discharge processing in S8 is the last discharge processing executed when an image is recorded on one sheet P (S9). When the controller 100 has determined that the discharge processing in S8 is not the last discharge processing (S9: NO), the controller 100 controls the carriage driving motor 20 to start the return operation in which the carriage 4 moves leftward (S10). The controller 100 updates the variable N to [N+1] (S11), and determines whether the variable N after the update is three (S12). When the controller 100 has determined that the variable N is three (S12: YES), the controller 100 executes the second discharge-state determination operation (S13), which is explained below while referring to FIG. 9. When the controller 100 has determined in the second discharge-state determination operation that all the nozzles 10 as the determination targets are the normal nozzles (S14: YES), the controller 100 proceeds to processing in S17.

When the controller 100 has determined that at least one nozzle 10 as the determination target is the abnormal nozzle rather than the normal nozzle (S14: NO), the controller 100 drives the carriage driving motor 20 to move the carriage 4 to the standby position. Then, the controller 100 controls the maintenance mechanism 8 to execute the suction purge (S15). This suction purge makes all the nozzles 10 of the head 30 the normal nozzles. Then, the controller 100 moves the carriage 4 leftward from the standby position to a position where the next discharge processing starts (S16) and proceeds to processing in S17.

In the processing of S17, the controller 100 resets the variable N to zero. After completing the processing in S17, the controller 100 proceeds to processing in S19.

When the controller 100 has determined in the processing of S12 that the variable N is not three (S12: NO), the controller 100 drives the head 30 to execute the flushing operation after the carriage 4 moves to the left detection range DL through the return operation (S18). After completing the processing in S18, the controller 100 proceeds to the processing in S19.

In the processing of S19, the controller 100 controls the conveyance motor 21 to execute the conveyance processing in which the sheet P is conveyed by a predefined conveyance amount. After that, the controller 100 returns to the processing in S8 to execute the next discharge processing.

When the controller 100 has determined in the processing of S9 that the discharge processing in S8 is the last discharge processing executed when an image is recorded on one sheet P (S9: YES), the controller 100 controls the conveyance motor 21 to execute sheet-discharge processing (S20) in which the sheet P for which the image has been recorded is discharged on a discharge tray (not depicted). Then, the controller 100 determines whether the image recording on the sheet P related to the recording instruction is completed (S21). When the controller has determined that the image recording is completed (S21: YES), the controller 100 drives the carriage driving motor 20 to move the carriage 4 to the standby position (S22). Then, the controller 100 returns to the processing in 51. When the controller 100 has determined that the image recording is not yet completed (S21: NO), the controller 100 returns to the processing in S6 to record an image on the next sheet P.

<First Discharge-State Determination Operation>

Figure 7A:
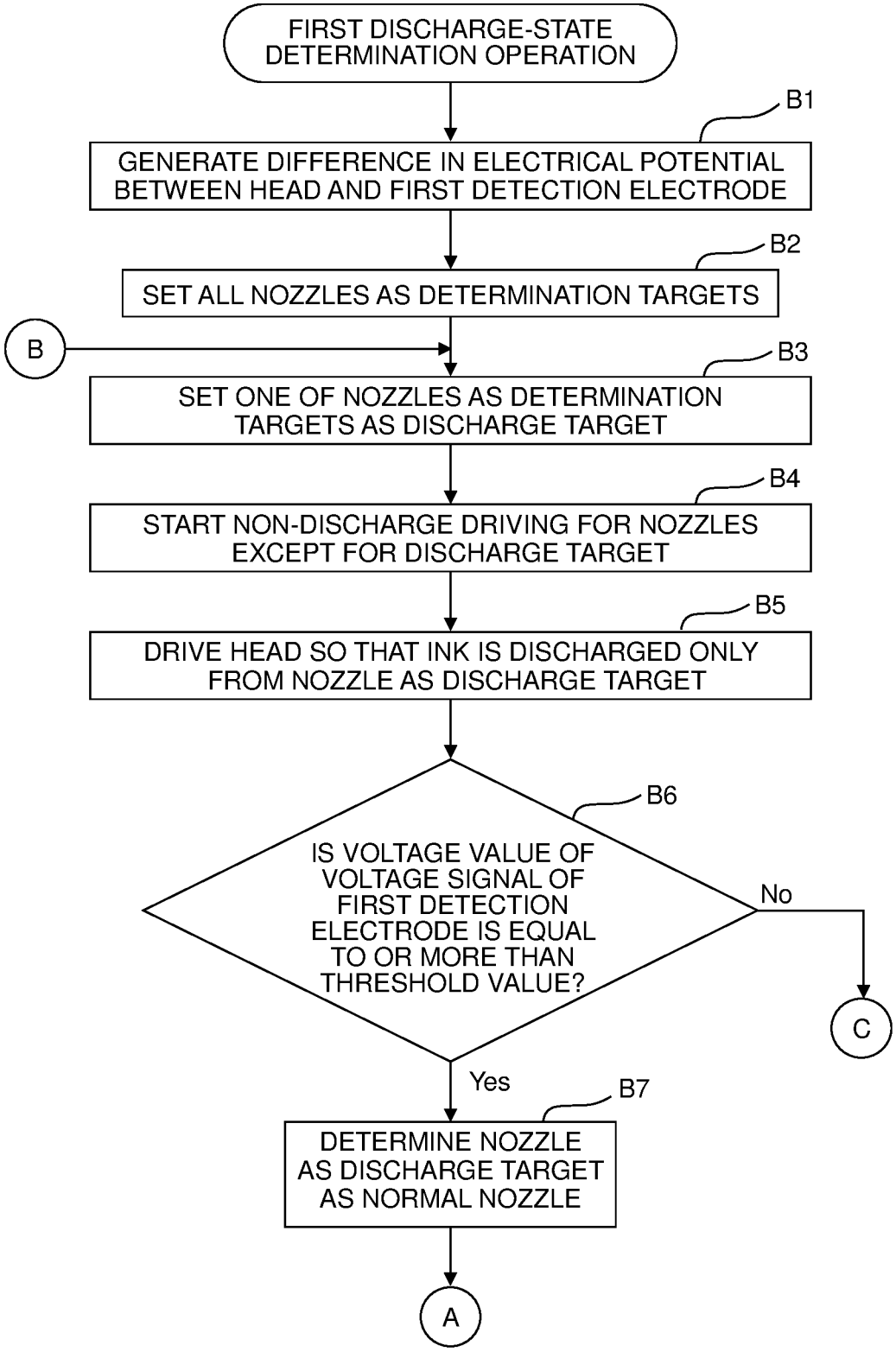
FIGS. 7A and 7B indicate a flowchart explaining a first discharge-state determination operation.
Figure 7B:
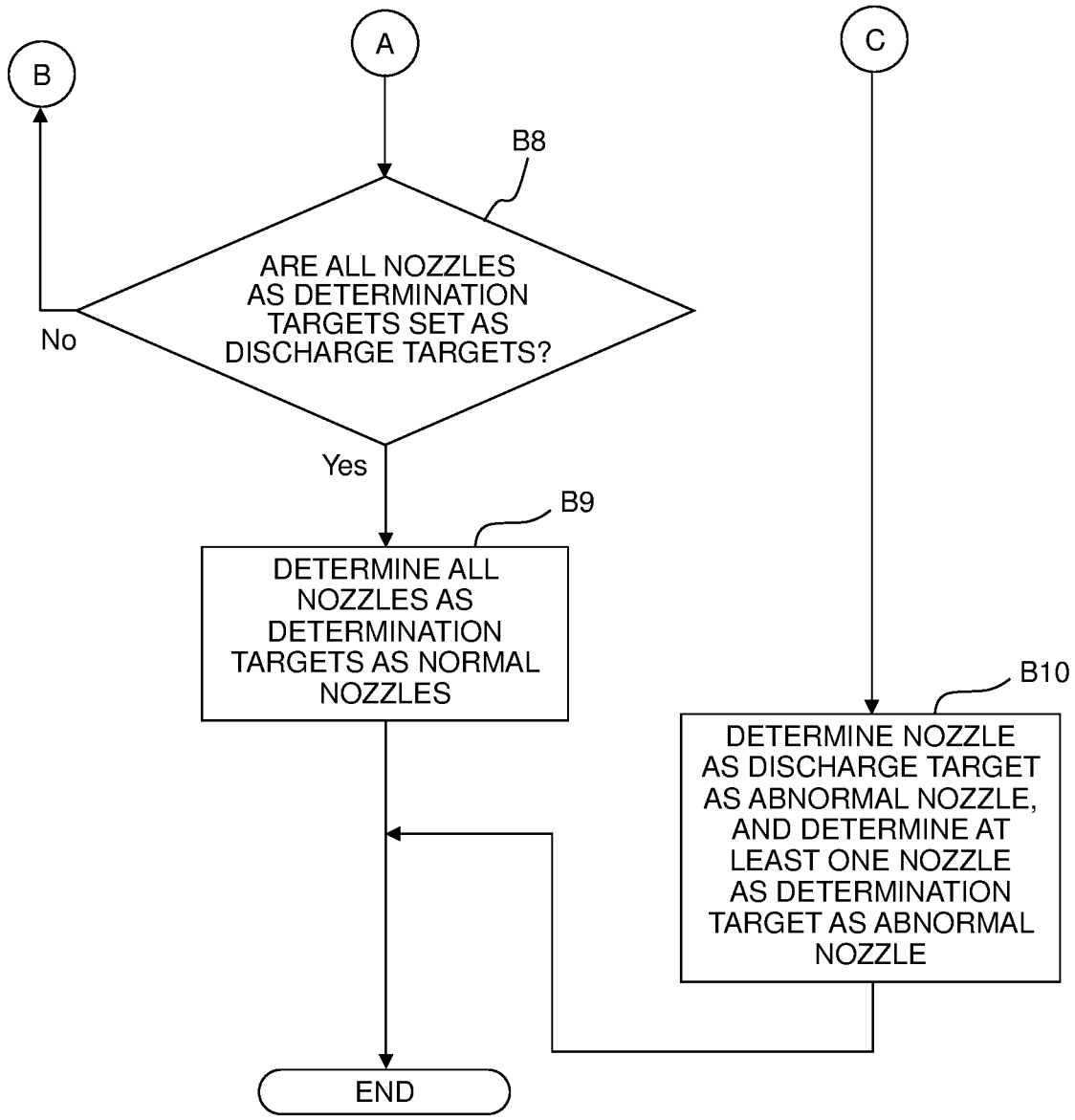

Referring to FIGS. 7 and 8, the first discharge-state determination operation is explained. The carriage 4 is in the standby position (right detection range DR) at the start of the first discharge-state determination operation.

As indicated in FIG. 7, the controller 100 first controls the high-voltage power circuit 63 to generate a difference in electrical potential between the head 30 and the first detection electrode 61 (B1). Then, the controller 100 sets all the nozzles 10 of the head 30 as the determination targets (B2). Subsequently, the controller 100 sets one of the nozzles 10 as the determination targets as a discharge target (B3).

Subsequently, the controller 100 controls the head 30 to start non-discharge driving in which the ink in each nozzle 10 of the head 30 except for the discharge target is vibrated to an extent that no ink is discharged therefrom (B4). The first discharge-state determination operation thus inhibits the ink in each nozzle 10 except for the discharge target from thickening due to the drying of ink. Subsequently, the controller 100 drives the head 30 so that a predefined number of ink droplets are discharged from only the nozzle 10 as the discharge target (B5).

Figure 8A:
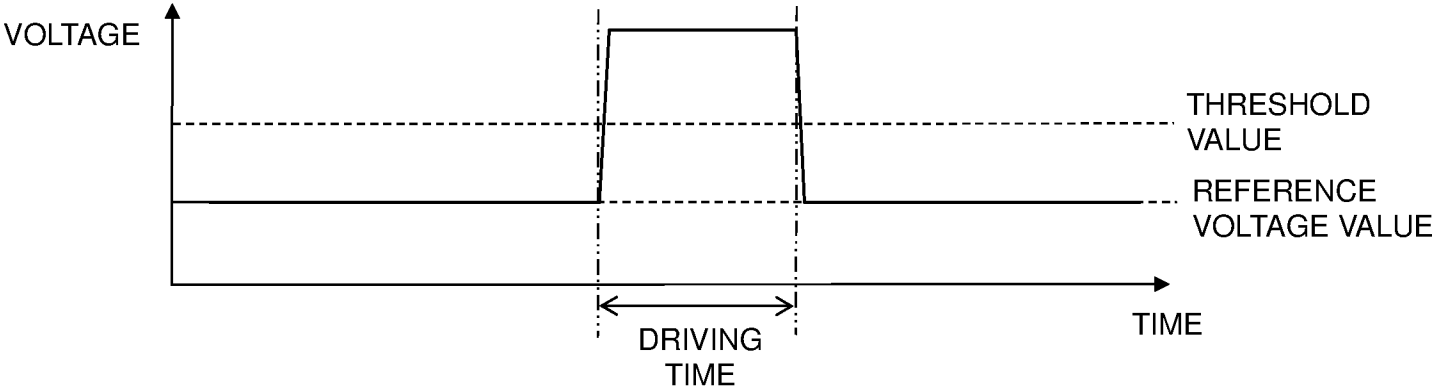
FIG. 8A depicts a voltage signal that is output from a detection electrode when ink is discharged from a nozzle as a detection target.
Figure 8B:
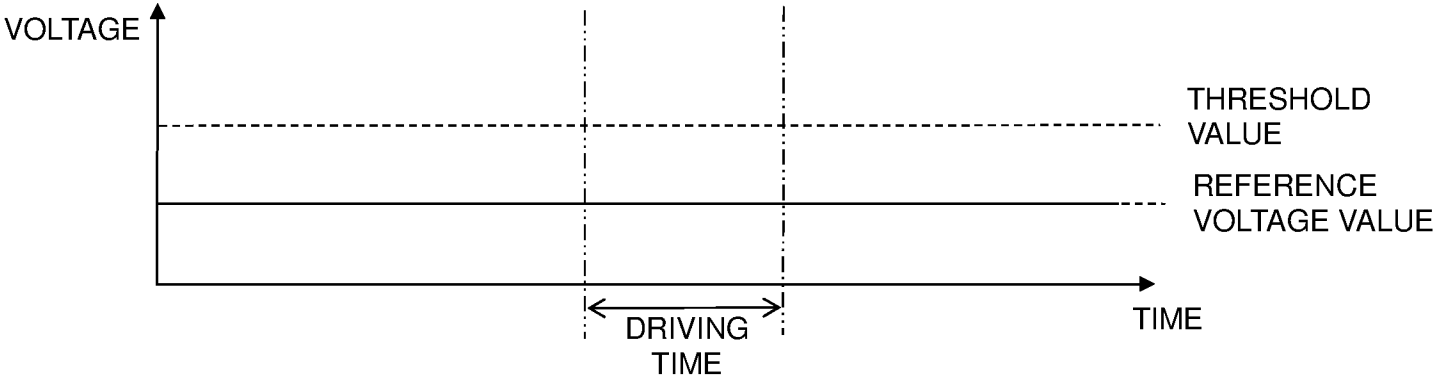
FIG. 8B depicts a voltage signal that is output from the detection electrode when no ink is discharged from the nozzle as the detection target.

In B5, since the difference in electrical potential between the head 30 and the first detection electrode 61 is generated, the ink discharged from the nozzle 10 as the discharge target is charged with electricity. Electrical change is caused in the first detection electrode 61 when the charged ink approaches the first detection electrode 61 and lands thereon. The voltage value of the voltage signal output from the first detection electrode 61 changes depending on the electrical change caused in the first detection electrode 61. Namely, as indicated in FIG. 8A, the voltage value of the voltage signal output from the first detection electrode 61 while the head 30 is driven is higher than a voltage value (hereinafter referred to as a reference voltage value) while the head 30 is not driven. When no ink is discharged from the nozzle 10 as the discharge target, as depicted in FIG. 8B, the voltage value of the voltage signal output from the first detection electrode 61 while the head 30 is driven is substantially the same as the reference voltage value. The determination circuit 64 thus sets the threshold value TH to distinguish the voltage value of the voltage signal output from the first detection electrode 61 and the reference voltage value. The determination circuit 64 compares the voltage value of the voltage signal output from the first detection electrode 61 while the head 30 is driven and the threshold value TH, and outputs the determination result to the controller 100.

When the determination circuit 64 has determined that the voltage value of the voltage signal of the first detection electrode 61 while the head 30 is driven is equal to or more than the threshold value TH (B6: YES), the controller 100 determines that the nozzle 10 as the discharge target is the normal nozzle (B7). Then, the controller 100 determines whether all the nozzles 10 as the determination targets have been set as the discharge targets (B8). When the controller 100 has determined that there is a nozzle 10 that is not set as the discharge target (B8: NO), the controller 100 returns to the processing in B3 to set the nozzle 10 that has not yet been set as the discharge target as the discharge target. When the controller 100 has determined that all the nozzles 10 as the determination targets have been set as the discharge targets (B8: YES), the controller 100 determines that all the nozzles 10 of the head 30 are the normal nozzles (B9) and ends the first discharge-state determination operation.

When the determination circuit 64 has determined in the processing of B6 that the voltage value of the voltage signal of the first detection electrode 61 while the head 30 is driven is less than the threshold value TH (B6: NO), the controller 100 determines that the nozzle 10 as the discharge target is the abnormal nozzle, and at least one nozzle 10 as the determination target is the abnormal nozzle (B10). Then, the controller 100 ends the first discharge-state determination operation.

<Second Discharge-State Determination Operation>

Figure 9A:
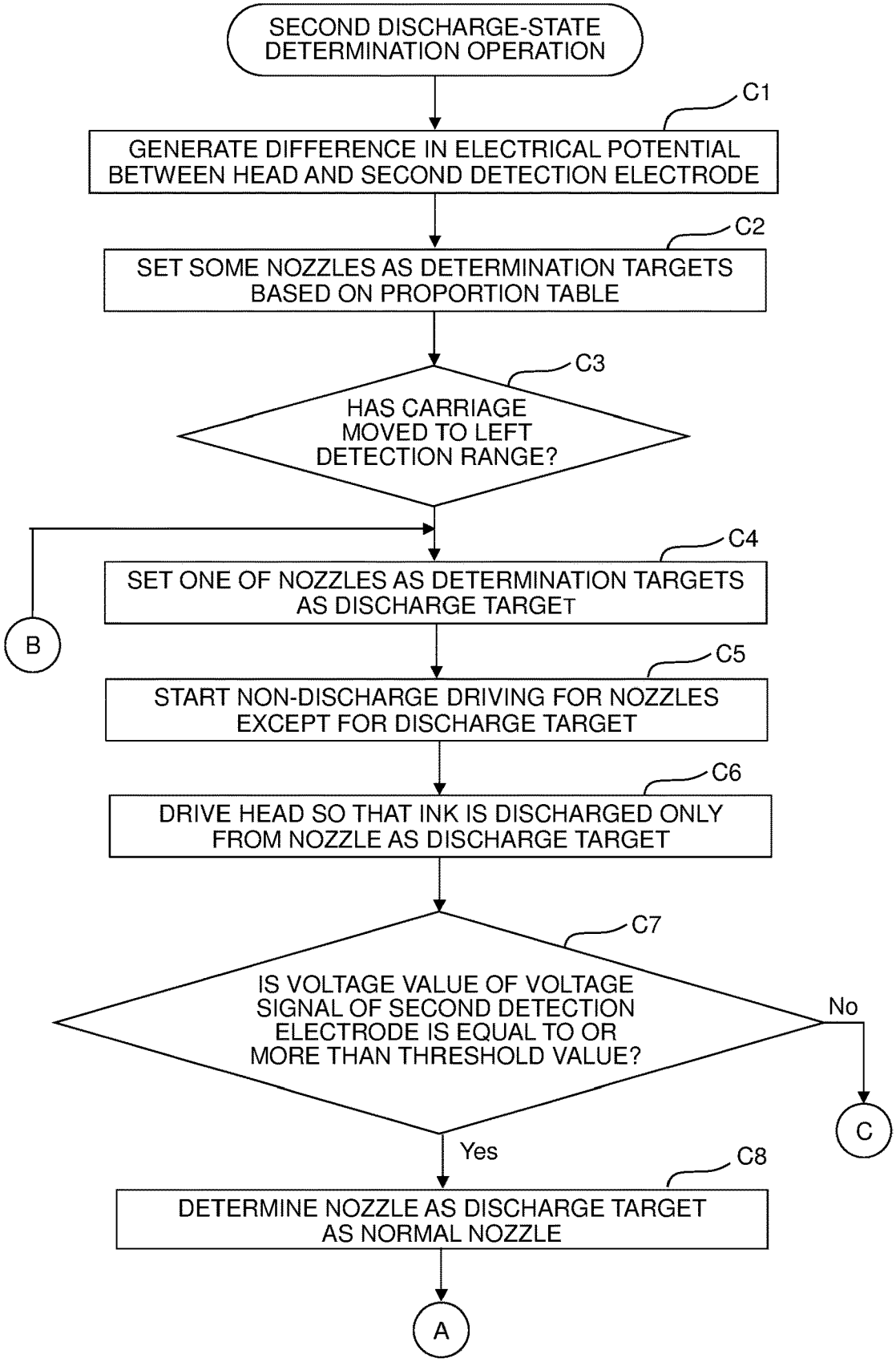
FIGS. 9A and 9B indicate a flowchart explaining a second discharge-state determination operation.
Figure 9B:
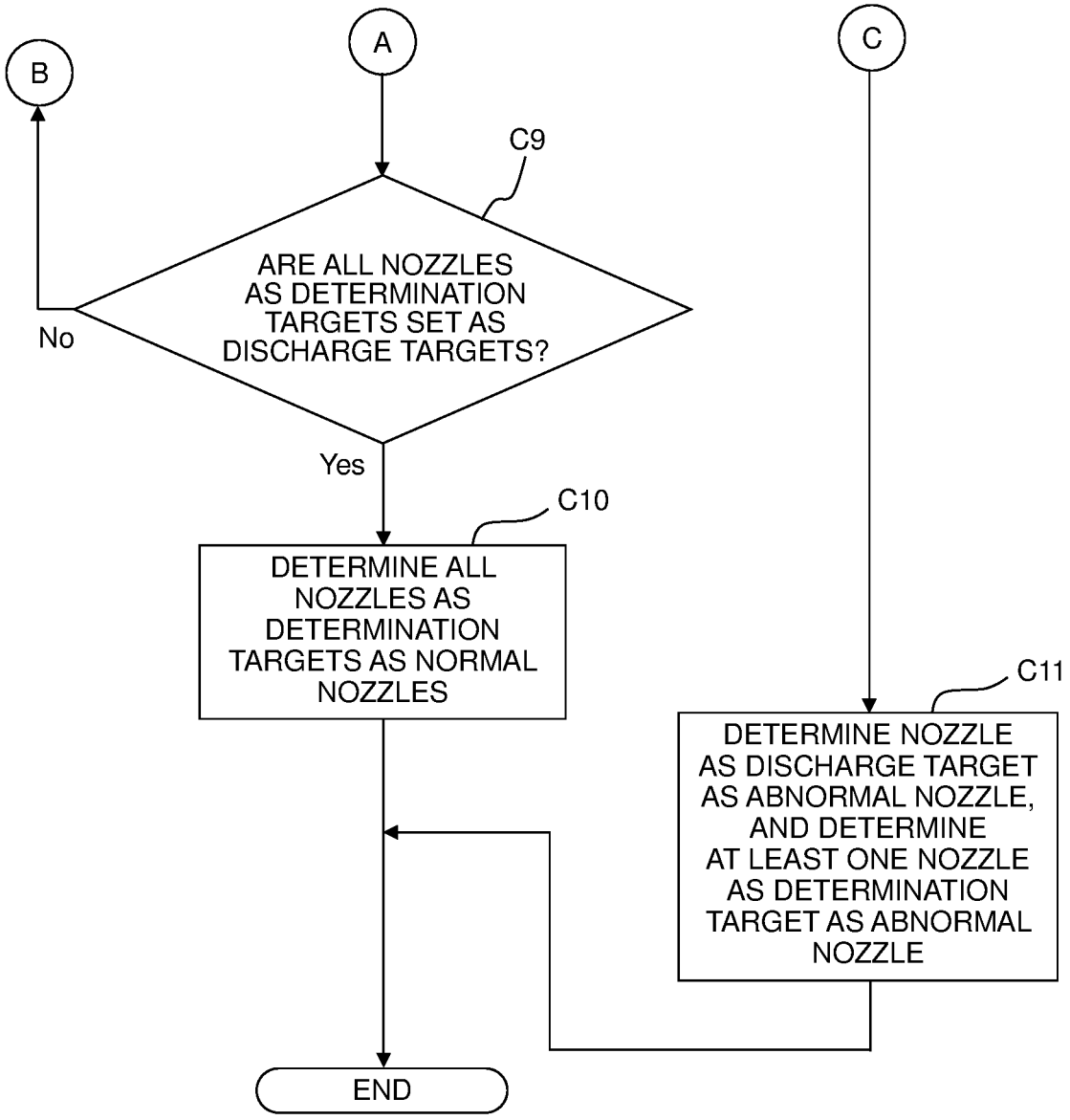

Referring to FIG. 9, the second discharge-state determination operation is explained below.

The controller 100 first controls the high-voltage power circuit 63 to generate a difference in electrical potential between the head 30 and the second detection electrode 62 (C1). Then, the controller 100 sets some of the nozzles 10 of the head 30 as the determination targets (C2) based on the proportion table 104*a* memorized in the flush memory 104.

After that, the controller 100 determines whether the carriage 4 has moved to the left detection range DL in the return operation (C3). When the controller 100 has determined that the carriage 4 has not moved to the left detection range DL (C3: NO), the controller 100 waits until the controller 100 determines that the carriage 4 has moved to the left detection range DL. When the controller 100 has determined that the carriage 4 has moved to the left detection range DL (C3: YES), the controller 100 sets one of the nozzles 10 as the determination targets as the discharge target (C4). The processing in C5 to C11 is substantially the same as the processing in B4 to B10, and thus only the differences therebetween are explained below. Namely, in the second discharge-state determination operation, ink is discharged from the nozzle 10 to the second detection electrode 62. The determination circuit 64 thus compares the voltage value of the voltage signal output from the second detection electrode 62 while the head 30 is driven and the threshold value TH, and outputs the result to the controller 100. When the controller 100 has determined that the voltage value of the voltage signal of the second detection electrode 62 while the head 30 is driven is equal to or more than the threshold value TH, the controller 100 determines that the nozzle 10 as the discharge target is the normal nozzle. When the controller 100 has determined that the voltage value of the voltage signal of the second detection electrode 62 while the head 30 is driven is less than the threshold value TH, the controller 100 determines that the nozzle 10 as the discharge target is the abnormal nozzle.

In this embodiment, the discharge state of the nozzle(s) 10 can be determined in the right detection range DR and the left detection range DL included in the movement range MR of the carriage 4. A time for moving the carriage 4 can thus be shortened when the determination of discharge state of the nozzle(s) 10 is executed. This consequently shortens a time until the determination of discharge state of the nozzle(s) 10 starts.

Figure 10:
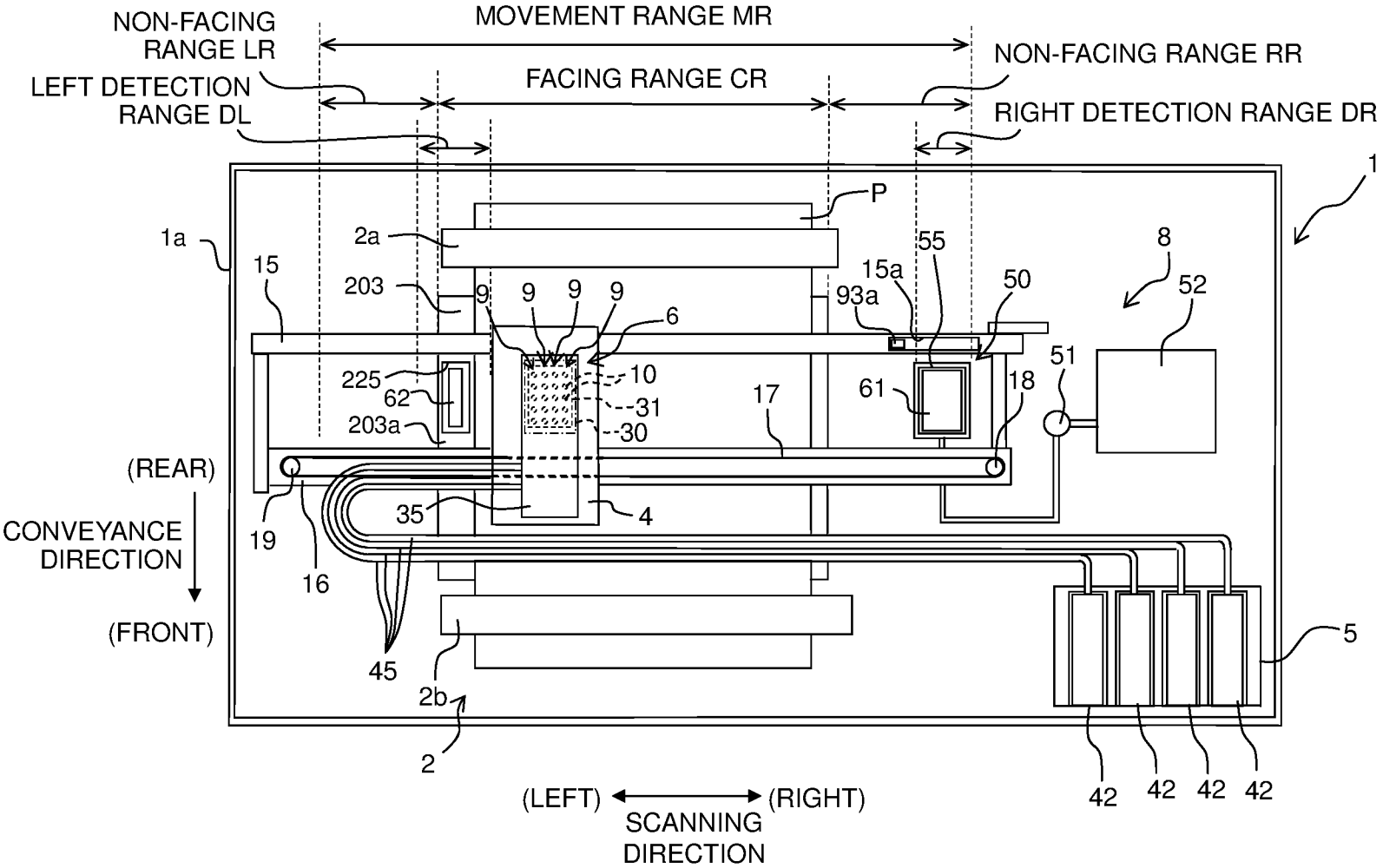
FIG. 10 schematically depicts an ink-jet printer according to a modified embodiment.

Although the embodiment of the present disclosure is explained above, the present disclosure is not limited to the above embodiment, and a variety of modifications are possible without departing from the claims. For example, the arrangement of the first detection electrode 61 and the second detection electrode 62 is not limited to that of the above embodiment. The first detection electrode 61 may be disposed at any other position than being disposed in the cap 55. Like a modified embodiment depicted in FIG. 10, the second detection electrode 62 may be placed on a platen 203. The modified embodiment depicted in FIG. 10 is explained below. In the following, the constitutive parts or components, which are the same as or equivalent to those of the above embodiment, are designated by the same reference numerals, any explanation therefor will be omitted as appropriate.

A printer 201 according to the modified embodiment depicted in FIG. 10 does not include the flushing receiver 25. A flushing receiver 225 is formed on the platen 203 supporting the sheet P conveyed by the conveyer 2. Specifically, the flushing receiver 225 is formed at a left end of the platen 203. The flushing receiver 225 is a recess or concave portion that is recessed downward from a support surface 203*a* of the platen 203 supporting the sheet P. The ink discharged from the nozzles 10 of the head 30 through the flushing operation is received by the flushing receiver 225.

In this modified embodiment, the second detection electrode 62 is disposed in the flushing receiver 225. Part of the left detection range DL belongs to the facing range CR, and the remaining part of the left detection range DL belongs to the non-facing range LR. The ink discharged from the nozzles 10 as the determination targets in the second discharge-state determination operation lands on the second detection electrode 62 in the flushing receiver 225.

As described above, also in this modified embodiment, the discharge state of the nozzles 10 can be determined in the right detection range DR and the left detection range DL included in the movement range MR of the carriage 4. This shortens the time for moving the carriage 4 when the determination of discharge state of the nozzles 10 is executed.

In the above modified embodiment, the second detection electrode 62 may be covered with the sheet P when the sheet width of the sheet P as a recording target is long and the sheet P is supported by the platen 203. In this case, the second discharge-state determination operation can not be executed while the sheet P is supported by the platen 203. Thus, the second discharge-state determination operation may be executed during a period, during which the second detection electrode 62 is not covered with the sheet P supported by the platen 203, in the execution of the recording processing. The period may be, for example, a period before or after an image is recorded on one sheet P.

Other modified embodiments are explained below.

In the above embodiment, the first detection electrode (first conductor for detection) and the second detection electrode (second conductor for detection) are the detection electrodes on which the ink discharged from the nozzle 10 lands when the determination of discharge failure of the nozzle 10 is executed. The present disclosure, however, is not limited thereto. The first detection electrode (first conductor for detection) and the second detection electrode (second conductor for detection) may be any in which electrical change is caused by the ink discharged from the nozzle 10. The first detection electrode (first conductor for detection) and the second detection electrode (second conductor for detection) may thus be, for example, conductors on which the ink discharged from the nozzle 10 does not land but in which an induced current is caused when the ink discharged from the nozzle 10 approaches them.

The standby position where the carriage 4 faces the cap unit 50 in the up-down direction is not limited to the right end of the movement range MR. The right end of the right detection range DR may thus be at the left of the right end of the movement range MR. In this case, the distance between the right end of the right detection range DR and the right end of the movement range MR may be longer than the distance between the left end of the left detection range DL and the left end of the movement range MR. Further, when the first discharge-state determination operation is executed in the above configuration, the head 30 may be driven to discharge the ink from the nozzles 10 while the carriage 4 moves in the right detection range DR. The movement velocity of the carriage 4 in the first discharge-state determination operation is preferably slower than the movement velocity of the carriage 4 in the second discharge-state determination operation in view of the contact between the carriage 4 and the switching lever 93, the possibility that the nozzle surface 30*a* gets dirty due to the ink bouncing off the first detection electrode 61, the arrangement of the first detection electrode 61 in the cap 55, and the like. In the second discharge-state determination operation, the head 30 may be driven to discharge ink from the nozzle surface 30*a* in a state where the carriage 4 is stopped.

In the above embodiment, the landing surface of the first detection electrode 61 on which ink lands is the facing surface 61*a* parallel to the nozzle surface 30*a* (horizontal plane). The present disclosure, however, is not limited thereto. Namely, the landing surface of the first detection electrode 61 may be a surface of which inclination angle with respect to the nozzle surface 30*a* is gentler than the inclined surface 62*a* of the second detection electrode 62. In this case also, ink is more likely to bounce off the landing surface of the first detection electrode 61 than the inclined surface 62*a*. In the above embodiment, the surface of the second detection electrode 62 on which ink lands is the inclined surface 62*a* inclined to the nozzle surface 30*a*. The present disclosure, however, is not limited thereto. The surface of the second detection electrode 62 on which ink lands may be a surface parallel to the nozzle surface 30*a*.

In the above embodiment, the right detection range DR belongs to the non-facing range RR. The present disclosure, however, is not limited thereto. For example, part of the right detection range DR may belong to the facing range CR. In the first discharge-state determination operation, when ink is discharged from the nozzles 10 during the movement of the carriage 4, inertial force is acted on the ink discharged from the nozzles 10. Thus, also in the configuration in which the first detection electrode 61 is disposed on the right of the platen 3, if the carriage 4 moves rightward, ink is capable of landing on the first detection electrode 61 with the carriage 4 positioned in the facing range CR. Similarly, the left detection range DL is not limited to the above, provided that the left detection range DL is disposed on the left of the right detection range DR.

The first discharge-state determination operation may be executed also during the execution of the recording processing. For example, when the discharge state determination operation is executed during the execution of the recording processing, whether the first discharge-state determination operation or the second discharge-state determination operation is executed may be determined depending on the position of the carriage 4, the distance to the right detection range DR, and the distance to the left detection range DL.

In the above embodiment, the driving-force switching mechanism 23 operates through the movement of the carriage 4. The present disclosure, however, is not limited thereto. The operation of the driving-force switching mechanism 23 may be controlled, for example, by the controller 100.

In the first discharge-state determination operation of the above embodiment, all the nozzles 10 of the head 30 are set as the determination targets. Only some of the nozzles 10, however, may be set as the determination targets. Further, all the nozzles 10 of the head 30 may be set as the determination targets in the second discharge-state determination operation.

In the first discharge-state determination operation of the above embodiment, the nozzles as the determination targets have mutually different discharge timings. The nozzles as the determination targets, however, may have the same discharge timing. Specifically, the electrical change in the first detection electrode 61 is larger as the number of nozzles 10 from which ink is discharged while the head 30 is driven is larger. Namely, the voltage value of the voltage signal output from the first detection electrode 61 while the head 30 is driven is higher as the number of nozzles 10 from which ink is discharged is larger. The controller 100 thus sets multiple nozzles 10 as the discharge targets and drives the head 30 so that a predefined number of ink droplets are discharged from the nozzles 10 as the discharge targets. The determination circuit 64 may compare the voltage value of the voltage signal output from the detection electrode 61 depending on the driving of the head 30 with a predefined threshold value. The predefined threshold value may be an intermediate value (average value) of a setting voltage value of a voltage signal when all the nozzles 10 as the discharge targets are the normal nozzles and a setting voltage value of a voltage signal when one nozzle 10 is the abnormal nozzle. The setting voltage values are voltage values obtained through experiment, simulation, or the like in advance. Similarly, in the second discharge-state determination operation, the nozzles as the determination targets may have the same discharge timing.

In the first and second discharge-state determination operations of the above embodiment, the difference in electrical potential between the head 30 and each of the detection electrodes 61 and 62 is caused. This is not indispensable. Namely, even when there is no difference in electrical potential between the head 30 and each of the detection electrodes 61 and 62, the ink discharged from the nozzles 10 is slightly charged with electricity when separating from the nozzle surface 30*a*. When the ink charged approaches each of the detection electrodes 61 and 62 and lands thereon, the voltage signal output from each of the detection electrodes 61 and 62 becomes higher than the reference voltage value. Accordingly, although determination accuracy may be lower than the above embodiment, the discharge state of the nozzles 10 can be determined when there is no difference in electrical potential between the head 30 and each of the detection electrodes 61 and 62.

In the above embodiment, the abnormal nozzle is determined as a non-discharge nozzle from which no ink can be discharged. The present disclosure, however, is not limited thereto. For example, when the volume of ink discharged from the nozzle 10 is reduced, the voltage value of the voltage signal output from each of the detection electrodes 61, 62 is lower by the reduced volume. Thus, it is possible to execute determination of the nozzle 10 from which a predefined volume of ink can not be discharged, provided that the threshold value TH in the determination circuit 64 is set appropriately. Thus, in addition to the non-discharge nozzle, the nozzle from which a predefined volume of ink can not be discharged may be set as the abnormal nozzle.

In the above embodiment, the conveyance system of the sheet P of the conveyer is a roller conveyance system using the conveyance rollers 2*a* and 2*b*. The present disclosure, however, is not limited thereto. The conveyance system may be any other conveyance system. For example, the conveyance system may be a belt conveyance system using a conveyance belt. In the belt conveyance system, the sheet P may be conveyed while being attracted to the conveyance belt. The attraction method of the sheet P is exemplified, for example, by an electrostatic attraction method in which static electricity is generated on a surface of the conveyance belt to attract the sheet P and an air attraction method in which through holes passing the conveyance belt in a thickness direction are provided to suction air through the through holes and to attract the sheet P.

When the conveyance system of the conveyer is the belt conveyance system, one of the detection electrodes (first conductor for detection) may be disposed at one side in the scanning direction from the passing area where the sheet P conveyed by the conveyance belt passes. The other of the detection electrodes (second detection conduction portion)

may be disposed at the other side in the scanning direction from the passing area or at a position included in the passing area. For example, when the liquid receiver receiving the liquid discharged from the nozzle(s) is provided in the conveyance belt, the second conductor for detection may be disposed in the liquid receiver.

The conveyance system of the conveyer may be a system in which the sheet P is conveyed using both the conveyance rollers and the conveyance belt. The recording medium may be a roll of paper that is continuous paper wound like a roll. In this case, the conveyer may include a winding mechanism that winds the roll of paper at a downstream side in the conveyance direction from the ink-jet head (carriage).

Figure 11:
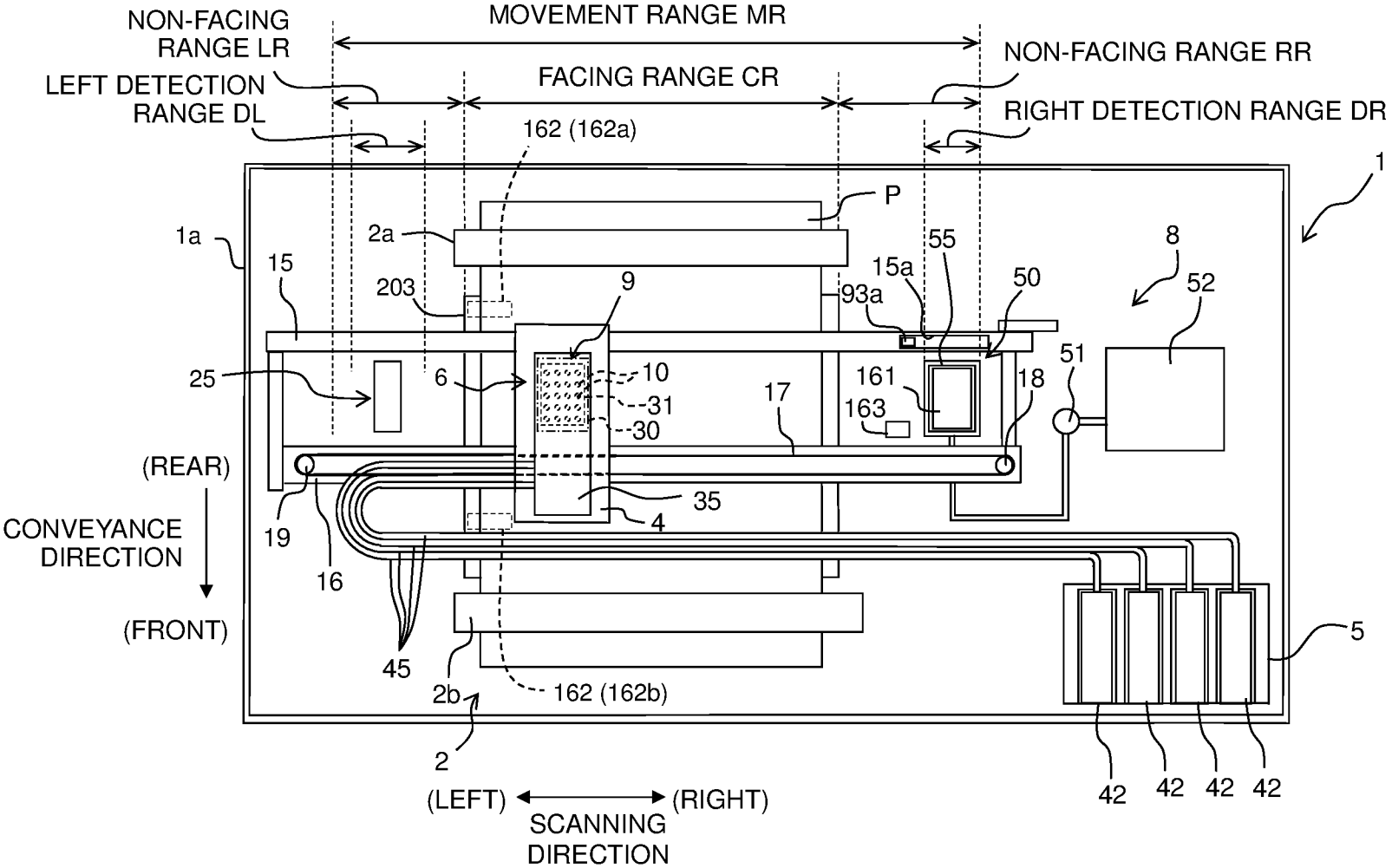
FIG. 11 schematically depicts an ink-jet printer according to another modified embodiment.

In the above embodiment, the nozzle inspection apparatus 40 that inspects the discharge state of the nozzle(s) 10 includes the first detection electrode 61 and the second detection electrode 62. The present disclosure, however, is not limited thereto. For example, as depicted in FIG. 11, the nozzle inspection apparatus 140 may include a detection electrode 161, an optical detector 162, and a hygrometer 163. The detection electrode 161 is disposed in the cap 55 like the first detection electrode 61 of the above embodiment. Since the detection electrode 161 has the same structure as the first detection electrode 61 of the above embodiment, the explanation therefor is omitted here. The optical detector 162 is disposed at a position overlapping with a left end of the platen 203. The optical detector 162 includes an irradiation unit 162A that irradiates illumination light, and a light receiving unit 162B that receives the light from the irradiation unit 162A. The irradiation unit 162A and the light receiving unit 162B are arranged at an interval with the nozzle rows 9 interposed therebetween in the conveyance direction. The light from the irradiation unit 162A is received by the light receiving unit 162B, and the intensity thereof is measured. Unlike a case in which no ink is discharged from the nozzles 10, flying ink droplets block the light when ink is discharged. This reduces the intensity of the light received by the light receiving unit 162B. The optical detector 162 can thus detect whether ink is discharged from the nozzle(s) 10.

The detection electrode 161 outputs a voltage signal based on a change in electrical potential generated in the detection electrode 161 due to charged ink. Here, it is known that the charge amount of ink changes depending on the surrounding humidity. When the humidity is high, ink is difficult to be charged. This makes an output value of the voltage signal small and makes detection accuracy low. In order to solve that problem, when the humidity measured by the hygrometer 163 is higher than a predetermined threshold, the controller 100 may inspect the discharge state of the nozzle(s) 10 by use of the optical detector 162 instead of the detection electrode 161. Further, the controller 100 may inspect the discharge state of the nozzle(s) 10 by use of the detection electrode 161, when the humidity measured by the hygrometer 163 is lower than a predetermined threshold.

In the above example, the detection electrode 161 is disposed in the cap 55 and the optical detector 162 is disposed at a position overlapping with the left end of the platen 203. However, the detection electrode 161 may be disposed at a position overlapping with the left end of the platen 203 and the optical detector 162 may be disposed in the cap 55.

In the above embodiment, the first electrode 61 and the second electrode 62 are parallel to the nozzle surface, and the length of the first detection electrode 61 in the scanning direction is longer than the length of the second detection electrode 62 in the scanning direction. Therefore, the length of the detection range of the first detection electrode 61 in the scanning direction is longer than the length of the detection range of the second detection electrode 62 in the scanning direction. The ink discharged from a certain nozzle 10 may be detected by the first detection electrode 61, but may not be detected by the second detection electrode 62. In this case, the controller 100 can determine that the ink discharged from the certain nozzle 10 is flying while curving or deviating in the scanning direction. Namely, the controller 100 can determine that the ink discharged from the certain nozzle 10 has a flying curve or flying deviation. In this case, since it is considered that foreign matter adheres to the certain nozzle 10, the controller 100 can wipe the nozzle surface with a wiper W instead of the suction purge. When the ink discharged from the certain nozzle 10 is not detected by both the first detection electrode 61 and the second detection electrode 62, the controller 100 can determine that no ink is discharged from the certain nozzle 10. In this case, like the above embodiment, the suction purge solves the non-discharge of the certain nozzle.

When the optical detector 162 is used, the detection range of the optical detector 162 may be adjusted by adjusting the irradiation range in the scanning direction of the light from the irradiation unit 162A or the light receiving range in the scanning direction of the light receiving unit 162B. Thus, both when multiple optical detectors are combined together and when the optical detector and the detection electrode(s) are combined together, the flying curve of ink can be detected.

The optical detector is not limited to the above configuration. For example, the optical detector may include a light emitting unit that emits focused light such as laser light and a light receiving unit. In this case, the laser light can detect the ink discharged from nozzle(s) belonging to one nozzle row or several nozzle rows. Further, the optical detector may include an imaging unit that captures an image (moving image or still image). In this case, the presence or absence of ink discharge can be detected based on the image captured by the imaging unit.

The serial-type ink-jet head that performs printing during the movement of the head in the scanning direction is adopted in the above-described embodiment and modified embodiments of the present disclosure. Note that in the serial-type ink-jet head as described above, the head unit may be removably attached onto the carriage. The present disclosure, however, may be applied to a line-type ink-jet head that performs printing in a state where the head stands still. When a movable line-type ink-jet head is used, the nozzle inspection apparatus can be disposed outside the printing area as in the above embodiment. Further, when the ink-jet head is not movable, the nozzle inspection apparatus may be configured to be movable between a storage position away from the printing area and a detection position below the head. Both the head and the nozzle inspection apparatus may be configured to be movable. The printer that records an image on a sheet by discharging ink from nozzles is adopted in the above embodiment and the modified embodiments of the present disclosure. The present disclosure, however, is not limited thereto. The present disclosure is applicable to a liquid discharge apparatus that discharges liquid on any other recording medium than the sheet P. For example, the recording medium may be a T-shirt, a sheet for out-of-home advertising, and the like. The present disclosure can be applied to a liquid discharge apparatus that performs recording on a trace (wiring) board by discharging any other liquid than ink, such as a material of a trace (wiring) pattern. The present disclosure can be applied to a liquid discharge apparatus that performs recording on a medium, such as cases of mobile terminals including smartphones, cardboard, and resin, by discharging ink thereon.

What is claimed is:

1. A liquid discharge apparatus, comprising:

a conveyer;

a head having a nozzle surface in which a nozzle is opened;

a carriage configured to carry the head, the carriage being movable in a scanning direction parallel to the nozzle surface in a movement range including a facing range that faces a passing area where a recording medium conveyed by the conveyer passes;

a first conductor for detection arranged at a first side in the scanning direction relative to the passing area, and configured to generate an electrical detection signal responding to landing a liquid discharged from the nozzle onto the first conductor for detection; and a second conductor for detection arranged at a second side, which is opposite to the first side, in the scanning direction relative to the passing area, and detecting an electrical signal responding to landing a liquid discharged from the nozzle onto the second conductor for detection.

2. The liquid discharge apparatus according to claim 1, further comprising: a controller configured to:

determine a discharge state of the nozzle by driving the head to discharge the liquid from the nozzle based on a first signal output from the first conductor for detection depending on the driving, in a case that the carriage is in a first detection range included in the movement range; and determine a discharge state of the nozzle by driving the head to discharge the liquid from the nozzle based on a second signal output from the second conductor for detection depending on the driving, in a case that the carriage is in a second detection range included in the movement range and positioned at the second side in the scanning direction from the first detection range.

3. The liquid discharge apparatus according to claim 2, further comprising a platen configured to support the recording medium conveyed by the conveyer, wherein the movement range of the carriage includes a platen facing range facing the platen in the scanning direction;

the first conductor for detection is disposed at the first side in the scanning direction relative to the platen; and the second conductor for detection is disposed at the second side in the scanning direction relative to the platen.

4. The liquid discharge apparatus according to claim 3, further comprising a cap disposed at the first side in the scanning direction relative to the platen and configured to cover the nozzle, and the first conductor for detection is disposed in the cap.

5. The liquid discharge apparatus according to claim 4, wherein, in a case that the controller determines the discharge state of the nozzle based on the first signal, the controller is configured to drive the head such that the liquid is discharged from the nozzle while moving the carriage in the first detection range included in the movement range at a first movement velocity or stopping the carriage in the first detection range, and in a case that the controller determines the discharge state of the nozzle based on the second signal, the controller is configured to drive the head such that the liquid is discharged from the nozzle while moving the carriage in the second detection range at a second movement velocity that is faster than the first movement velocity.

6. The liquid discharge apparatus according to claim 5, wherein the first detection range is positioned at the first side in the scanning direction from the facing range, the controller is configured to:

record an image on the recording medium by discharging the liquid from the nozzle while moving the carriage in the scanning direction;

determine the discharge state of the nozzle based on the first signal, in a case that the controller determines the discharge state of the nozzle in a state where the carriage is positioned in the first detection range; and determine the discharge state of the nozzle based on the second signal, in a case that the controller determines the discharge state of the nozzle in a state where the carriage is not positioned in the first detection range and the image is being recorded.

7. The liquid discharge apparatus according to claim 6, wherein the controller is configured to execute flushing in which the head discharges the liquid from the nozzle, in a case that the carriage is positioned in the second detection range, and in a case that the carriage has moved from an outside of the second detection range to the second detection range during the recording of the image, the controller is configured to execute one of the flushing and determining the discharge state of the nozzle based on the second signal.

8. The liquid discharge apparatus according to claim 7, wherein the second detection range is positioned at the second side in the scanning direction from the facing range, and in a case that the carriage has moved from the facing range to the second detection range during the recording of the image, the controller is configured to execute one of the flushing and determining the discharge state of the nozzle based on the second signal.

9. The liquid discharge apparatus according to claim 2, further comprising a platen configured to support a recording medium conveyed by the conveyer, wherein the movement range of the carriage includes a platen facing range facing the platen in the scanning direction, the first conductor for detection is disposed at the first side in the scanning direction relative to the platen, and the second conductor for detection is disposed in the platen.

10. The liquid discharge apparatus according to claim 3, further comprising a liquid receiver disposed at the second side in the scanning direction relative to the platen and configured to receive the liquid discharged from the nozzle, and the second conductor for detection is disposed in the liquid receiver.

11. The liquid discharge apparatus according to claim 5, wherein the second conductor for detection has a surface inclined to the nozzle surface, and in a case that the discharge state of the nozzle is determined based on the second signal, the liquid discharged from the nozzle lands on the surface of the second conductor for detection, the first conductor for detection has a surface inclined to the nozzle surface, and in a case that the discharge state of the nozzle is determined based on the first signal, the liquid discharged from the nozzle lands on the surface of the first conductor for detection, and, an inclination angle between the surface of the first conductor for detection and the nozzle surface is gentler than an inclination angle between the surface of the second conductor for detection and the nozzle surface.

12. The liquid discharge apparatus according to claim 5, wherein the cap includes a base portion and a cylindrical lip portion standing from the base portion and having a tip configured to be brought into contact with the head, and the first conductor for detection is disposed in the cap at a position closer to the base portion than the tip of the lip portion.

13. The liquid discharge apparatus according to claim 5, further comprising: a driving source; a driving object; and a switching mechanism configured to switch between a transmission state and a blocking state by being brought into contact with the carriage, in a case that the carriage moves from the facing range to the first detection range, wherein a driving force of the driving source is transmitted to the driving object in the transmission state, and a transmission of the driving force to the driving object is blocked in the blocking state.

14. The liquid discharge apparatus according to claim 13, further comprising a maintenance mechanism that includes the cap and the driving object and is configured to execute maintenance of the head by use of the driving force transmitted from the driving source to the driving object.

15. The liquid discharge apparatus according to claim 5, wherein the nozzle in the head is one of a plurality of nozzles in the head, in a case that the carriage is positioned at an end at the first side in a conveyance direction of the movement range, a first nozzle at an end at the first side in a head that is included in the plurality of nozzles is positioned at the second side from an end at the first side of the first conductor for detection, and in a case that the carriage is positioned at an end at the second side in the conveyance direction of the movement range, a second nozzle at an end at the second side in the head that is included in the plurality of nozzles is positioned at the second side from an end at the second side of the second conductor for detection.

16. The liquid discharge apparatus according to claim 15, wherein a distance between the end at the second side of the movement range and the end at the second side of the second detection range is longer than a distance between the end at the first side of the movement range and the end at the first side of the first detection range.

17. The liquid discharge apparatus according to claim 5, wherein the nozzle in the head is one of a plurality of nozzles in the head, the controller is configured to determine discharge states of the plurality of nozzles by driving the head such that the liquid is discharged from all the nozzles, in a case that the controller determines the discharge states of the plurality of nozzles based on the first signal, and the controller is configured to set a part of the plurality of nozzles as discharge targets, drive the head such that the liquid is discharged only from the part of the plurality of nozzles, and determine discharge states of the part of the plurality of nozzles in the driving, in a case that the controller determines the discharge states of the plurality of nozzles based on the second signal.

18. The liquid discharge apparatus according to claim 17, wherein the head has a liquid supply port and a plurality of channels ranging from the liquid supply port to the plurality of nozzles respectively, and the controller is configured to increase a frequency of setting a certain nozzle included in the plurality of nozzles and positioned further away from the liquid supply port as one of the discharge targets based on the second signal, in the case that the determination of a discharge state of the certain nozzle is executed.

19. A liquid discharge apparatus comprising:

a conveyer;

a head having a nozzle surface in which a nozzle is opened;

a first detection portion configured to detect flying of liquid discharged from the nozzle in a first detection range that is parallel to the nozzle surface, and a second detection portion configured to detect flying of the liquid discharged from the nozzle in a second detection range that is parallel to the nozzle surface and is smaller than the first detection range.

20. The liquid discharge apparatus according to claim 19, further comprising a controller configured to determine that the liquid is not discharged from the nozzle, in a case that both the first detection portion and the second detection portion do not detect the flying of the liquid discharged from the nozzle, the controller being further configured to determine that a flying curve of the liquid discharged from the nozzle occurs, in a case that the first detection portion has detected the flying of the liquid discharged from the nozzle and that the second detection portion does not detect the flying of the liquid discharged from the nozzle.

21. The liquid discharge apparatus according to claim 20, further comprising a wiper configured to wipe the nozzle surface, wherein the controller is configured to execute a purge in which the liquid is forcibly discharged from the nozzle, in the case that the controller has determined that the liquid is not discharged from the nozzle, and the controller is configured to execute wiping in which the nozzle surface is wiped with the wiper, in the case that the controller has determined that the flying curve of the liquid occurs.

22. A liquid discharge apparatus, comprising:

a conveyer;

a head having a nozzle surface formed having a nozzle from which a liquid is discharged on a recording medium conveyed by the conveyer;

a conductor for detection configured to detect flying of a liquid discharged from the nozzle by detecting an electrical signal generated by the flying of the liquid; and an optical detector configured to optically detect the flying of the liquid discharged from the nozzle.

23. The liquid discharge apparatus according to claim 22, further comprising a hygrometer configured to measure humidity of an inside of the liquid discharge apparatus, and a controller, wherein the controller is configured to control the optical detector to detect the flying of the liquid discharged from the nozzle, in a case that the humidity is equal to or more than a threshold value.

* * * * *